US007407246B2

(12) United States Patent
Vanhooydonck

(10) Patent No.: US 7,407,246 B2
(45) Date of Patent: Aug. 5, 2008

(54) METHOD AND APPARATUS TO CREATE A WAVEFORM FOR DRIVING A PRINTHEAD

(75) Inventor: Rudi Vanhooydonck, Zwijndrecht (BE)

(73) Assignee: Agfa Graphics NV, Mortsel (BG)

( * ) Notice: Subject to any disclaimer, the term of this patent is extended or adjusted under 35 U.S.C. 154(b) by 318 days.

(21) Appl. No.: 11/175,536

(22) Filed: Jul. 6, 2005

(65) Prior Publication Data

US 2006/0012624 A1 Jan. 19, 2006

(30) Foreign Application Priority Data

Jul. 16, 2004 (EP) ..... 04103402

(51) Int. Cl.
*B41J 2/155* (2006.01)

(52) U.S. Cl. ..... 347/15; 347/10

(58) Field of Classification Search ..... 347/10, 347/11, 9, 15, 12, 5, 56, 57
See application file for complete search history.

(56) References Cited

U.S. PATENT DOCUMENTS

| | | | | |
|---|---|---|---|---|
| 4,513,299 | A | 4/1985 | Lee et al. | |
| 5,202,659 | A | 4/1993 | DeBonte et al. | |
| 5,285,215 | A | 2/1994 | Liker | |
| 6,102,513 | A | 8/2000 | Wen | |
| 6,811,238 | B2 * | 11/2004 | Shingyohuchi | 347/11 |

* cited by examiner

*Primary Examiner*—Lamson D. Nguyen
(74) *Attorney, Agent, or Firm*—Keating & Bennett, LLP

(57) ABSTRACT

A method provides an optimized set of waveforms for driving a printhead in greyscale printing wherein the waveforms include a pulse train of N pulses, wherein N is an integer, each pulse having a length $L_N$, a time $P_{(N-1)(N)}$ existing between two adjacent pulses. The method includes: optimising a cost function that compares at least one ink ejection parameter such as drop velocity, difference in drop velocity, driving voltage, split velocity, number of split drops or drop placement error, with a printing speed parameter such as printing speed, the length $L_N$ of each pulse or the time $P_{(N-1)(N)}$ between two adjacent pulses.

4 Claims, 14 Drawing Sheets

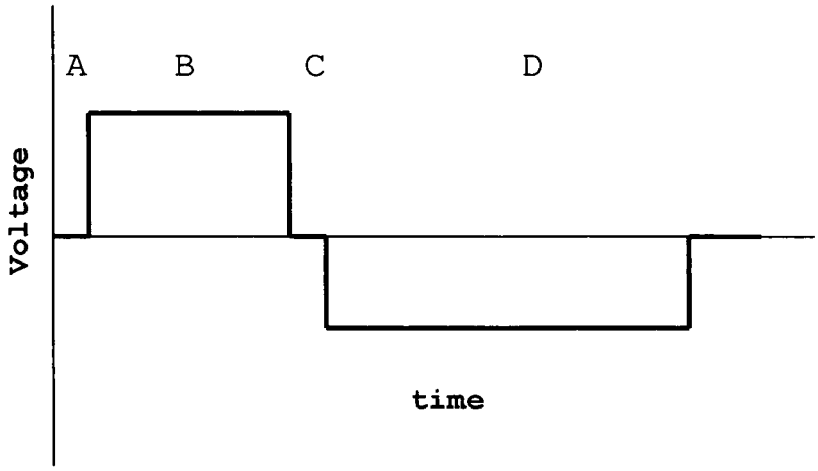
Fig. 3 - PRIOR ART
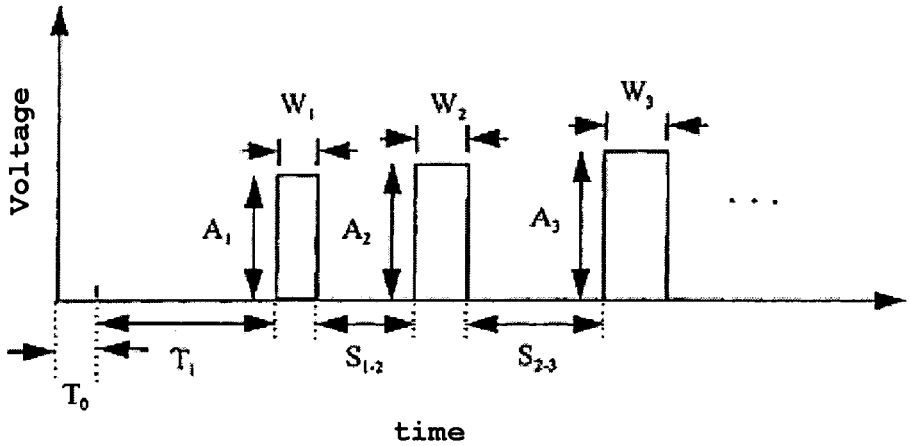
Fig. 4 - PRIOR ART
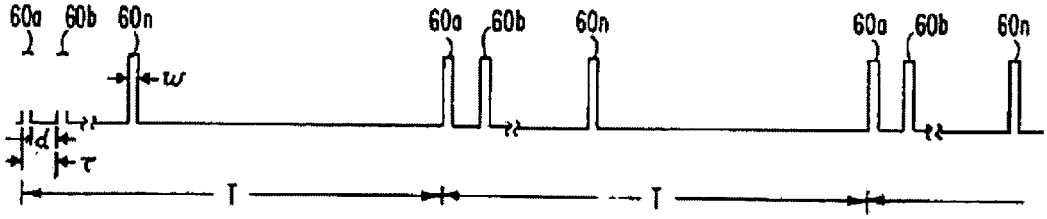
Fig. 5 - PRIOR ART

METHOD AND APPARATUS TO CREATE A WAVEFORM FOR DRIVING A PRINTHEAD

FIELD OF THE INVENTION

The present invention relates to design method for optimising greyscale printing as well as an apparatus designed by the design method, e.g. a printer or a printer controller, that optimises greyscale printing and a method of operating such an apparatus. More specifically the invention is related to a method and apparatus for making a waveform to create ink drops that have the same velocity, especially for an inkjet printer, as well as a controller suitable for controlling a printer to generate such drops.

BACKGROUND OF THE INVENTION

Greyscale inkjet technology operates in a similar way to binary inkjet printing but has the ability to fire a range of drop sizes. The greyscale effect is achieved by firing multiple droplets from the same nozzle of a printhead in rapid succession, rather than a single droplet as occurs at binary applications. The salvo of droplets merges in flight to form inked areas, on the printing substrate, of variable size and therefore of variable greyscale and can enable the production of an enhanced image quality at equal spatial resolution.

In FIG. 1 and FIG. 2 an example of a greyscale printhead is illustrated which includes three main parts, i.e. a cover component 1 and a channel component 2, both made from lead zirconium titanate (PZT), and a nozzle plate (not shown in the figures) made from a polyimide film. PZT is a piezoelectric material, which is a material that deforms when an electric field is applied to it. By sawing parallel grooves into the PZT channel component 2, the ink channels 3 and the shared walls 4 between the ink channels 3 are being defined. Furthermore, electrodes 5, to which a voltage can be applied to eject a drop of ink out of a nozzle, are positioned at the upper parts of the shared walls 4. Finally, a cover component 1 is attached to the tops of the shared walls 4 by a thin rigid layer of glue.

Typically, in one form of printer, the printhead will be moved relative to the printing substrate to produce a so-called raster line which extends in a first direction, e.g. across a page. The first direction is sometimes called the "fast scan" direction. A raster line includes a series of sequential dots delivered onto the printing medium by the marking elements of the printhead. The printing medium is moved, usually intermittently, in a second direction perpendicular to the first direction. The second direction is often called the slow scan direction.

In FIG. 3 a general waveform that may be used to drive a channel for printing a single droplet, is illustrated. The waveform in FIG. 3 consists of 4 parts A, B, C and D. The voltage at the ordinate shows the voltage across the shared walls 4 of the printing channel, i.e. the voltage between the electrodes 5 of the printing channel and the electrodes 5 of the neighbouring channels. From the change from A to B on, the voltage at for example channel Cb is kept positive. Simultaneously, the voltage at its neighbouring channels Ca and Cc is kept low. The voltage difference between the channel Cb and its neighbouring channels Ca and Cc creates an outward bending of the shared walls 4 of channel Cb, as is shown in FIG. 1. Hence, a low pressure or vacuum occurs and ink flows into channel Cb. This phase is called the pull phase. By changing from part B to part C in the waveform as shown in FIG. 3, the shared walls 4 return in their original position, the pressure increases and a droplet is created. During the D-phase, which is also called push phase, the voltage at channel Cb is low and the voltage at its neighbouring channels Ca and Cc is positive. The shared walls 4 bend inward as is shown in FIG. 2. The deflection of the shared walls 4 of channel Cb pressurises the ink in the ink channel, ejecting the ink droplet from nozzle of channel Cb.

To create the waveform of FIG. 3 and drive a channel to eject a single droplet, a combination of the following three signals may be applied to the electrodes of the printing channel and its neighbouring channels, for example:

| | |
|---|---|
| On (on-signal): | 01111111110000000000000000000000 |
| Off (off-signal): | 00000000000011111111111111111000 |
| Ina (inactive-signal): | 00000000000011111111111111111000 |

So, for driving a single channel of the above described grayscale printhead three signals are required, i.e. an on-signal (on), an off-signal (off) and an inactive-signal (ina) (see FIG. 1 and FIG. 2). In commercially available drive circuitry for these grayscale printheads each drive signal is 480 bits long. One single little drop or droplet is determined by 32 bits. Thus, a maximum of 480/32=15 droplets can be created within one drive signal for merging together to form one big drop. If, for example, printing needs to be done with channel Cb, an on-signal is sent to channel Cb and an inactive-signal is sent on the two neighbouring channels Ca and Cc. To fire n droplets, the on-signal is sent n times to channel Cb during the first 32*n bits. During the following 32*(15-n) bits, the off-signal is sent to that channel Cb. In the same time the inactive-signal is sent to the two neighbouring channels Ca and Cc. Each of the bits takes a time of one sample-clock period. The sample clock may be chosen dependent on the drive signal required.

Present-day printers need to be fast and accurate. Very important therefore is to have control over dot size and velocity. The dot size is related to the volume of the ink drop jetted and is determined by the number of ink droplets merged within the ink drop. Furthermore, it is also important that the ink drop is exactly positioned on the printing medium, which may for example be a paper or plastic sheet, in order to reduce drop misplacement printing artefacts of which most of them get worse as printing speed increases.

In U.S. Pat. No. 5,202,659, herein incorporated by reference in its entirety for background information only, a method for operating a drop-on demand ink jet printing system in resonant mode is described for providing high resolution printing upon a recording medium. According to this document, the volume of ink droplets ejected is controllable by synchronously exciting either one or a combination of the fluidic and mechanical resonant frequencies of the ink jet apparatus. Hereby a dominant resonant frequency disturbance is produced within the associated ink chamber permitting either one of one cycle or one sub-harmonic cycle of the dominant resonant frequency to be produced. The resonant oscillations generate multiple pulses. The method described in this document is a multi-pulse method using the dominant resonant frequency of the ink jet device to produce droplets of ink of controllable volume through pulsation of a transducer at a repetition rate of the dominant resonant frequency, using either a single or a plurality of pulses at the dominant resonant frequency, dependent on the dot size required.

U.S. Pat. No. 5,202,659 provides a method of operating an ink jet device using one or a multiple number of drive pulses for operating the device over a given dot production time for producing ink droplets, each of a known volume of ink. For this, the shape and periodicity of the drive pulses utilised are carefully controlled, whereby the periodicity of the drive pulses utilised is made substantially equivalent to the dominant resonant frequency of the ink jet device.

Thus, in U.S. Pat. No. 5,202,659 droplets are fired at a rate according to the resonant frequency. A disadvantage of the method is that, for creating different droplets, always the same waveform is to be used. Further, the resonant frequency can be sensitive to small changes in the mechanical properties of the printhead, imposing high consistency requirements on printhead manufacturing. Furthermore, to keep a system in resonance, less energy is needed than to get the system in resonance. By using the same waveforms to generate first and subsequent droplets, there will be an excess of energy present in the ink chamber, possibly leading to inconsistent or uncontrollable jetting.

In U.S. Pat. No. 6,102,513, herein incorporated by reference in its entirety for background information only, a method is described for variable greyscale printing while eliminating image artefacts caused by quantisation errors, visible noise and excessive ink lay-down while also reducing printing time and improving accuracy of ink drop placement. The method in U.S. Pat. No. 6,102,513 uses timing control of electronic waveforms for variable greyscale printing (see FIG. 4). The electronic waveform may include a plurality of "square" pulses and may be characterised by a set of predetermined parameters. The parameter values for the pulse amplitudes $A_1$, $A_2$, etc., pulse widths $W_1$, $W_2$, etc., and pulse delay time intervals $S_{1-2}$, $S_{2-3}$, etc. between pulses are selected according to a desired mode of operating the printhead.

In the desired mode, frequencies of pulses are reinforced by the resonance frequencies of the ink chamber. Hence, the amount of energy input to the channel to cause an ink drop ejection therefrom is minimised. It is important to control the timing of the waveforms in order to eliminate variability in ink drop placement caused by differences in pulse widths or delays, and to control voltage amplitudes of the waveform in order to eliminate variability in ejection velocity of drops. To correct for this, the waveform starts with a starting delay time $T_i$. In this known method the printhead may for example be designed such that ink drops having different volumes are ejected at essentially the same velocity. Timing control may be done depending on the operator-selected printing mode, printing speed, receiver type and/or output image resolution.

Although the method described in U.S. Pat. No. 6,102,513 deals with a number of the problems linked with the method described in U.S. Pat. No. 5,202,659, a disadvantage of the method is that three parameters per pulse have to be determined to create a waveform, i.e. pulse width, pulse delay and pulse amplitude. Furthermore, the method uses the resonance frequency of the ink chamber. Hence, the printing rate using this method is restricted to this resonance frequency.

In U.S. Pat. No. 5,285,215, herein incorporated by reference in its entirety for background information only, a method for operating an ink jet apparatus for providing selective control within a range of the volumes of the ink drops ejected by the apparatus and/or the amount of ink striking a desired point on a recording medium, is disclosed. It is alleged that broader control of the boldness and toning of printing could be obtained by operating a transducer of an ink jet printhead in an iterative manner. This causes a plurality of successively higher, lower or equal velocity ink droplets or some combination thereof to be ejected from the nozzle of the ink jet printhead, within a time period permitting the droplets to either merge in flight prior to striking a recording medium or upon striking the recording medium at the same point.

The volume of ink striking a recording medium at a given point is thereby partly determined by the number of ink droplets merged prior to striking or at the point of striking. In the document, the velocity of the droplets is determined by changing the amplitude or changing the fall time of the trailing edge of the control pulses. If either the amplitude of the control pulse is increased, or the fall time of the trailing edge is decreased, or a combination of both, the droplets ejected from the printhead will have an increased velocity.

Using the method described in U.S. Pat. No. 5,285,215 the shapes of the waveforms used to drive the ink jet apparatus can be designed to cause successively produced ink droplets to have successively higher or lower relative velocities, or some combination thereof, so long as system timing permits the droplets to strike the recording medium at substantially the same point. A disadvantage of the method described in this document is that again, 3 parameters need to be taken into account, i.e. amplitude of each pulse, the length of each pulse and the time between every two pulses. Furthermore, the time to eject for example two droplets that merge into one drop takes about 100 μs. Therefore, it is not possible to print at very high rates, using the method described in U.S. Pat. No. 5,285,215.

U.S. Pat. No. 4,513,299, herein incorporated by reference in its entirety for background information only, describes a method for generating ink drops on demand having selectively variable size. In this method, one subvolume of ink is produced for each voltage pulse applied to the printhead (see FIG. 5). In order to produce bigger volumes of ink, a successive number N of voltage pulses is applied to the printhead within one drop production times T. The delay time between the N voltage pulses generating the individual droplets is fixed and short with respect to T and all pulses have the same shape (see FIG. 5). The N droplets merge at the position of the nozzle plate and form a drop of which the volume equals N times the volume of one droplet. In this document it is assumed that the velocity of an ink drop, including different droplets, is determined by the velocity of the first of the droplets ejected from the printhead. According to this assumption, drops including different numbers of ink droplets thus all will have the same velocity, i.e. the velocity of the first droplet that has been ejected from the print head. However, practice shows that the bigger an ink drop is, the lower the velocity of the ink drop will be because, according to Stokes law, the friction force with the air will be higher for larger drops. Therefore, in practice, drops including a different number of droplets or subvolumes of ink appear to have a different velocity. Hence, the method described in U.S. Pat. No. 4,513,299 does not allow printing of ink drops, including a different number of droplets or subvolumes of ink, with all drops having the same velocity.

OBJECTS OF THE INVENTION

Although controlling the size and velocity of small ink drops or droplets merging together into one big ink drop is known from the prior art, most of the prior art methods have limited applicability at high printing rates or require a very elaborate control mechanism for waveform parameters. As present-day greyscale printers still require faster and more accurate printing methods, it would be advantageous to have the velocity of the small droplets as high as possible so they merge either on the nozzle plate or in flight before striking the printing substrate have all drop volumes flying at the same velocity to reduce dot misplacement errors, and have the number of waveform tuning parameters limited.

SUMMARY OF THE INVENTION

The above-mentioned and other problems are overcome by a system and method for providing an optimized set of waveforms for driving a printhead in greyscale printing wherein the waveforms include a pulse train of N pulses, wherein N is an integer, each pulse having a length $L_N$, a time $P_{(N-1)(N)}$ existing between two adjacent pulses, the method including: optimising a cost function that compares at least one ink ejection parameter including drop velocity, difference in drop velocity, driving voltage, split velocity, number of split drops and drop placement error, with a printing speed parameter including printing speed, the length $L_N$ of each pulse and the time $P_{(N-1)(N)}$ between two adjacent pulses.

Further advantages and embodiments of the present invention will become apparent from the following description and drawings.

BRIEF DESCRIPTION OF THE DRAWINGS

FIG. 3 shows a general waveform to drive the printhead of FIGS. 1 and 2.

FIG. 4 shows a waveform used for ejecting an ink drop including a number of small drops according to the prior art.

FIG. 5 shows a waveform used for ejecting an ink drop including a number of small drops according to the prior art.

Figure 1:
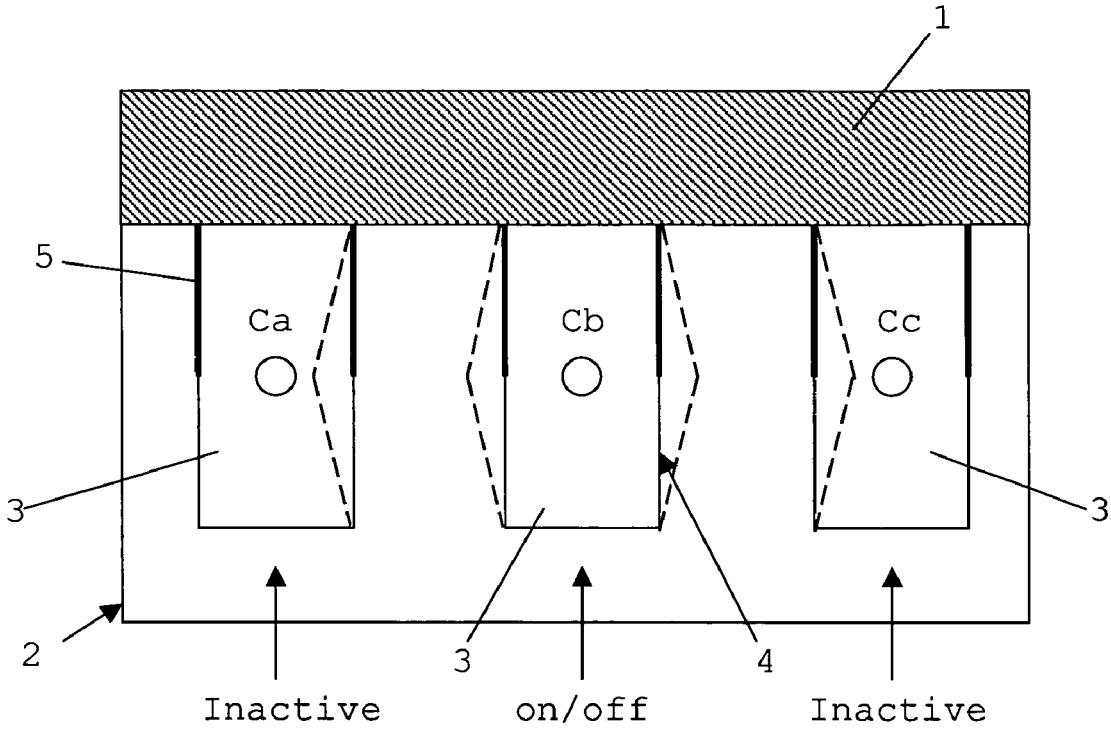
FIGS. 1 and 2 show a schematic view of part of a greyscale printhead which may be used in the present invention.
Figure 2:
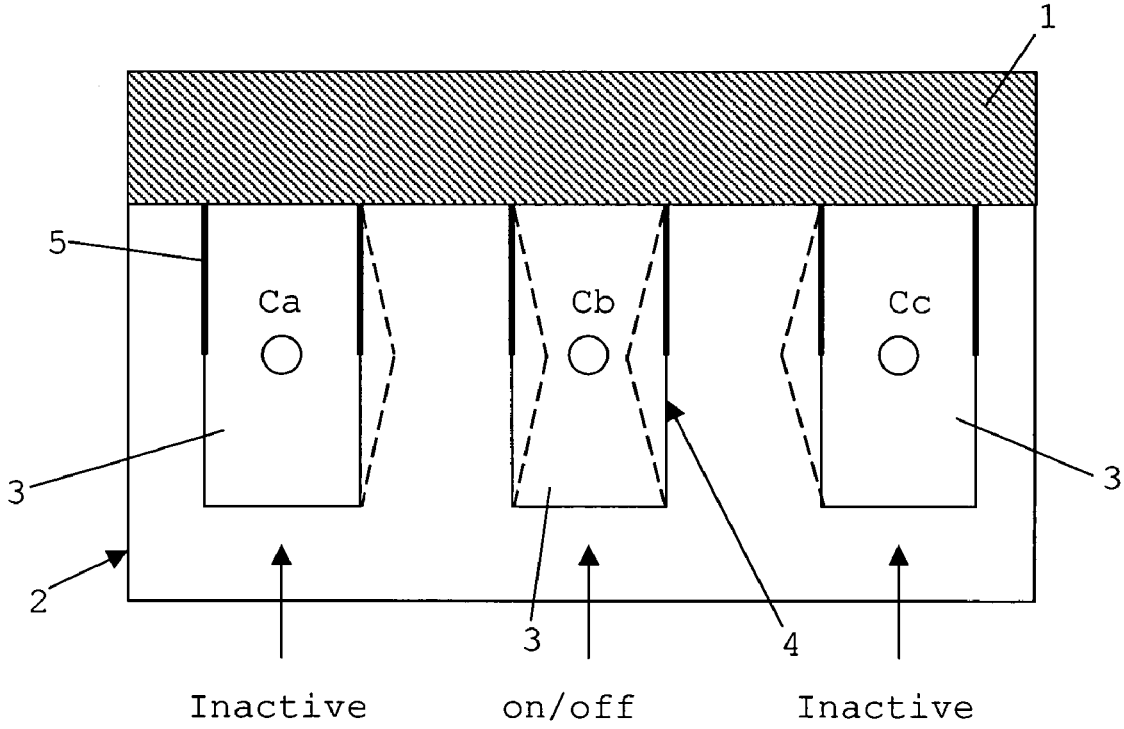

In the different figures, the same reference signs refer to the same or analogous elements.

DETAILED DESCRIPTION OF THE PREFERRED EMBODIMENTS

The present invention will be described with respect to particular embodiments or examples and with reference to certain drawings but the invention is not limited thereto but only by the claims. The drawings described are only schematic and are non-limiting. In the drawings, the size of some of the elements may be exaggerated and not drawn on scale for illustrative purposes.

Any form of printing or coating which involves firing drops or droplets onto a substrate is included within the scope of the present invention, e.g. piezoelectric printing heads may be used to print polymer materials as used for the printing of thin film transistors. Hence, the term "printing" in accordance with the present invention not only includes marking with conventional staining inks but also the formation of printed structures or areas of different characteristics on a substrate. One example is the printing of water repellent or water attractive regions on a substrate in order to form an offset printing plate by printing.

Accordingly, the term "printing medium" or "printing substrate" should also be given a wide meaning including not only paper, transparent sheets, textiles but also flat plates or curved plates which may be included in or be part of a printing press. In addition the printing may be carried out at room temperature or at elevated temperature, e.g. to print a hot-melt adhesive the printing head may be heated above the melting temperature.

Accordingly, the term "ink" should also be interpreted broadly including not only conventional inks but also solid materials such as polymers which may be printed in solution or by lowering their viscosity at high temperatures as well as materials which provide some characteristic to a printed substrate such as information defined by a structure on the surface of the printing substrate or water repellence. As solvents both water and organic solvents may be used. Inks as used with the present invention may include a variety of additives such as anti-oxidants, pigments and cross-linking agents.

The present invention provides a design method for designing a printing or marking device for optimised greyscale printing by creating new types of waveforms in order to optimise an ink ejection parameter. The present invention also includes a method for optimised greyscale printing using the new types of waveforms that optimise an ink ejection parameter. All printhead technologies using pulses to drive the printhead and applying these pulses to means for generating a volume of ink to be ejected from a printhead can benefit from a waveform designed according to the present invention.

The method according to the present invention may be used with piezoelectric ink jet printheads as well as thermal ink jet printheads and other types of ink jet printheads.

Some examples of an ink ejection parameter may be ink drop velocity, the amount of split drops after ejection or the deviation $\Delta y_{av}$, wherein $\Delta y_{av}$ is the average distance between the actual position of a drop of printing material and its corresponding ideal position. Further examples of ink ejection parameters may for example be drop size, existence of satellite drops and others.

Waveforms may be created such that the ink ejection parameters are optimised so as to achieve a stable printing system without resonance. The waveforms may be created digitally by using a plurality of bits, e.g. 480 bits, to generate a signal for ejecting an ink drop from the printhead. The ink drop may include a certain number of droplets. In the further description and in the claims the term droplet denotes a small volume of ink as part of a total drop volume. Hence, a droplet is what is ejected from the printhead and a drop is what strikes the printing substrate. At the time a drop strikes the printing substrate, all the droplets or subvolumes making the drop should have merged together to form a singular volume or single drop of ink.

The ink drop velocity is defined as the travel distance of the ink from the ejection location, i.e. the nozzle, at the printhead nozzle plate to a reference point, e.g. a fixed distance, divided by the time lapsed between creating a first droplet of the drop at the nozzle plate, i.e. at start of the waveform, and the drop reaching the reference point. The reference point can be for example the printing substrate and the time of arrival is the striking of the merged drop onto the printing substrate. This elapsed time is sometimes also referred to as drop flight time.

Figure 9:
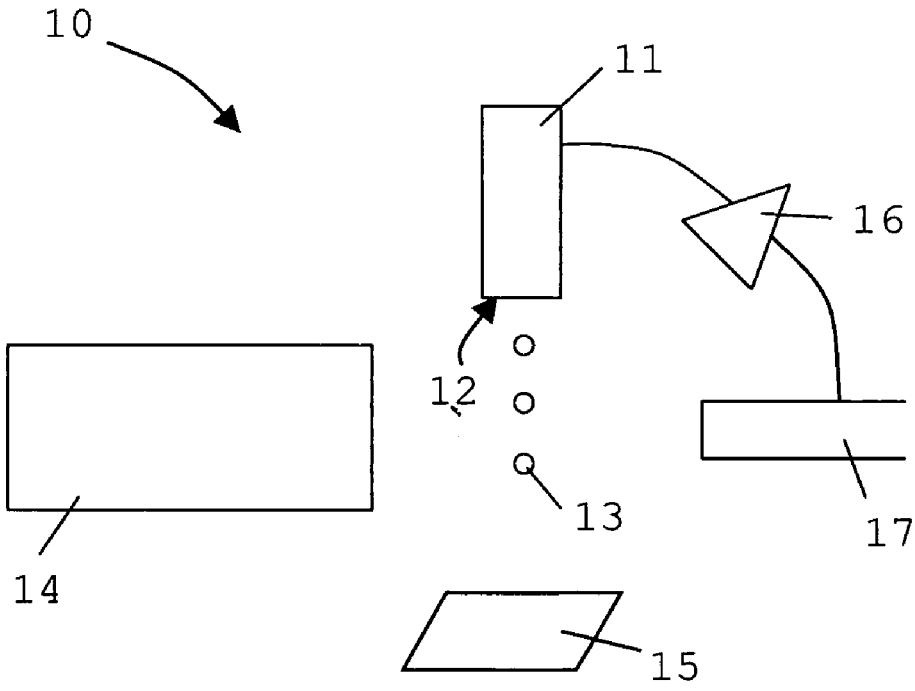
FIG. 9 shows a schematic illustration of a VisionJet™ system.
Figure 10:
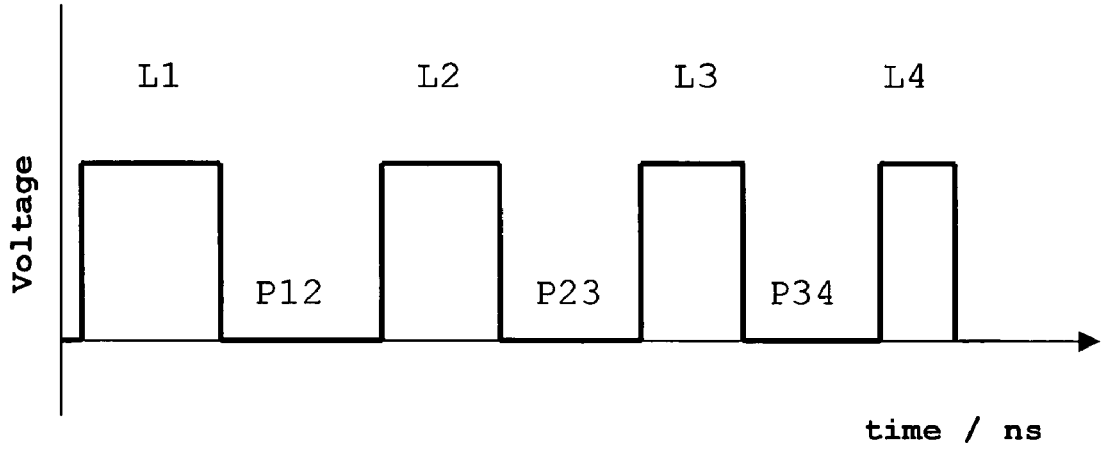
FIG. 10 shows a waveform for creating an ink drop with 4 dpd according to an embodiment of the present invention.

Methods for measuring this ink drop velocity may include a visual inspection system like for example a Visionjet Optica™ system commercially available from Xennia Technologies Ltd. A schematic representation of a VisionJet Optica system 10 is shown in FIG. 9. The ink drop velocity measuring method is described in more detail further in this description. This measuring method provides absolute drop velocity values. Methods for measuring differences between ink drop velocities of drops ejection from different nozzles in an array of nozzles may include printing a test pattern with these nozzles. This may be accomplished by establishing a relative perpendicular movement between the printing substrate and the array of nozzles and firing all the nozzles of the array simultaneously. Firing the nozzles of the array simultaneously will result in an array of printed dots on the printing substrate with a one-to-one correspondence between a printed dot and its originating nozzle. The printed dot pattern will reflect the nozzle pattern in the array, i.e. the printed dot location on the printing substrate will ideally map with the nozzle location in the array.

Assuming an equal straight distance from each of the nozzles in the array perpendicular to the printing substrate, which will be the case in most printing systems and has to be established otherwise, differences in drop velocity between different nozzles in the array will result in different drop landing positions, i.e. dot placement errors, relative to their ideally mapped position within the printed dot pattern. Having a measured velocity value for the relative movement between printing substrate and nozzle array, a measured value for the straight distance between the nozzle and the printing substrate and a value for the dot placement error, a difference in drop flight time and thus in drop velocity can be calculated.

An ideally mapped printed dot pattern, used as a reference and overlay for the above described calculations, can be obtained by firing all the nozzles in the nozzle array simultaneously and only once onto a printing substrate that is not moving relative to the nozzle array.

Figure 6:
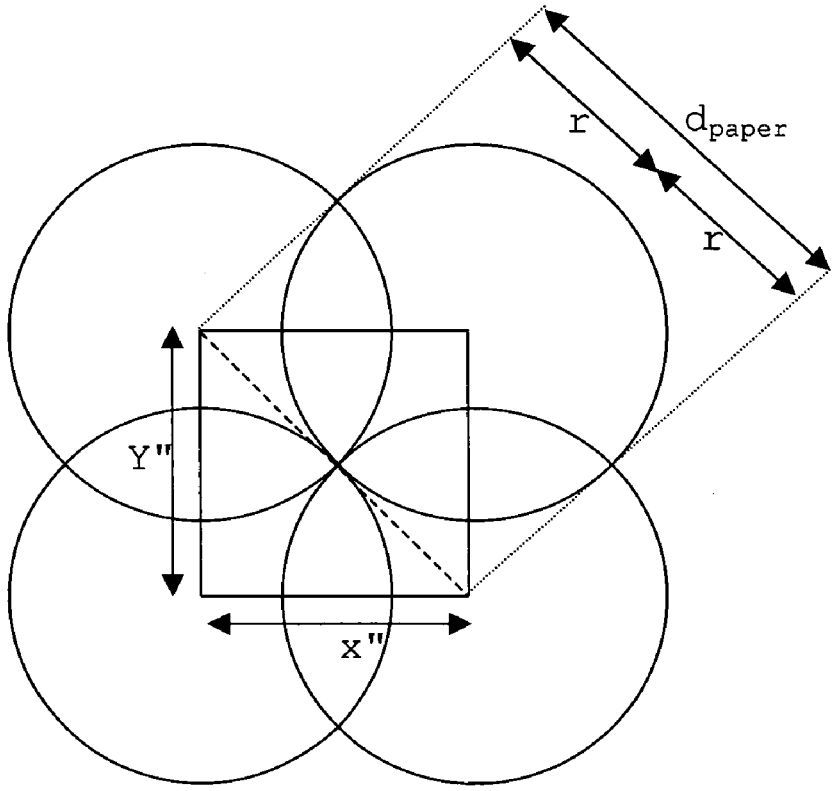
FIG. 6 illustrates determination of the required dot diameter for a particular printing resolution.

The number of droplets N to form one single drop may for example be between 1 and 15, preferably between 1 and 10, more preferably between 1 and 4 and most preferably 1 and 2. The number of droplets N may be determined as a function of droplet size and required resolution as follows. The resolution of a printing image may be expressed in terms of dpi (dots per inch). For an image of X dpi by Y dpi, whereby X and Y are in dots per inch, the distance X" and Y" between two dots respectively are 25400 μm/X and 25400 μm/Y (see FIG. 6). Hence, the maximum required dot diameter $d_{paper}$ of a drop landed on a printing substrate 1 may be determined by:

$$d_{paper}=\sqrt{X''^2+Y''^2} \tag{1}$$

A further important feature of an ink drop ejected from a printhead is the formfactor FF, which is defined as the ratio of the diameter $d_{paper}$ of a dot on a printing substrate and the diameter $d_{drop}$ of the drop corresponding with that dot and ejected from the printhead:

$$FF = \frac{d_{paper}}{d_{drop}} \tag{2}$$

and hence:

$$d_{drop} = \frac{d_{paper}}{FF} \tag{3}$$

The formfactor FF may depend on the type of printing substrate and the type of ink that is used. Knowing the diameter $d_{drop}$ of the drop that is ejected from the printhead, its volume $V_{drop}$ may be determined by:

$$V_{drop} = \frac{4}{3}\pi r^3 \tag{4}$$

wherein $r=d_{drop}/2$. By means of equation (4) the required total volume $V_{drop}$ of the ejected drop to print at 720 dpi×720 dpi may be determined.

For determining the number of droplets N necessary to form a drop with volume $V_{drop}$ may be determined by dividing the volume $V_{drop}$ by the volume $V_{droplet}$ of a single droplet:

$$N = \frac{V_{drop}}{V_{droplet}} \tag{5}$$

In a next specific example, the number of droplets N is determined for printing with a resolution of 720 dpi×720 dpi onto for example a micro-porous paper such as e.g. the commercially available Epson Premium Glossy Photo paper. A resolution of 720 dpi means that the distance X" and Y" (see FIG. 6) between two dots is 25400 μm/720=35.3 μm. By means of equation (1) the diameter of the dots on the printing substrate $d_{paper}$, to reach 100% coverage on the printing substrate, equals 49.9 μm.

Figure 7:
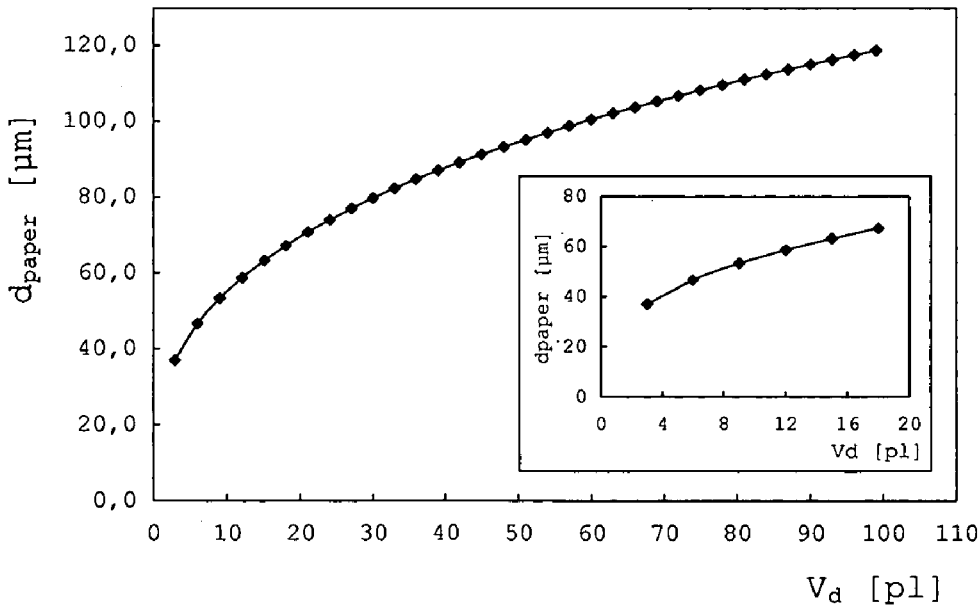
FIG. 7 shows the dot diameter of an ink drop hitting a printing medium as a function of its volume.

The graph on FIG. 7 shows the dot diameter $V_{paper}$ on a Epson Premium Glossy Photo paper as a function of drop volume $V_{drop}$, for an Agfa Sherpa Dye M (LDQBQ) ink. This graph can be determined experimentally by measurement. If for example individual droplets ejected from the printhead have a volume $V_{droplet}$ of 3 picoliter (pl), the diameter $d_{droplet}$ of these droplets is 18 μm. The diameter $d_{paper}$ of these droplets landed on the Epson Premium Glossy Photo paper may then be be determined by measurement.

As can be seen, in case of a drop with $V_{drop}$=3 pl, i.e. a drop consisting of a single droplet, $d_{paper}$ is measured to be about 37 μm. Hence, according to equation (2), the formfactor FF in this specific case equals 2.06. The diameter $d_{drop}$ required for drops to reach 100% coverage on the printing substrate may be determined by equation (3) and equals 24.22 μm. The total required volume $V_{drop}$ of these drops equals $7.44\times10^3$ $\mu m^3$ or 7.44 pl according to equation (4). According to equation (5), the number of droplets N with a volume $V_{droplet}$ of 3 pl, required in this specific case, is 2.48. Therefore the number of droplets N of the given Agfa Sherpa™ Dye M (LDQBQ) ink, necessary to print 100% coverage at 720 dpi×720 dpi on Epson Premium Glossy Photo paper with droplets of 3 pl, is set at 3.

In the above-described way, the number of droplets required for printing at different resolutions using droplets having a certain volume, may be determined. In table I, example values for N are calculated for basic droplets with different volumes and different printing resolutions.

TABLE 1

| $V_{droplet}$ | Resolution | N |
|---|---|---|
| 3 pl | 360 dpi × 360 dpi | 20 |
| | 720 dpi × 720 dpi | 3 |
| | 360 dpi × 720 dpi | 10 |
| 7 pl | 360 dpi × 360 dpi | 9 |
| | 720 dpi × 720 dpi | 2 |
| | 360 dpi × 720 dpi | 5 |

The number N of droplets need not be created and jetted as individual volumes of ink. The number N of droplets can also be created and jetted in quick succession and form a string of concatenated small ink volumes, so-called subvolumes. That is, as the droplets are created, they can already merge into a string of subvolumes of ink, at the exit of the nozzle of the printhead. This results in a spatially modulated drop that can then rearrange itself in flight due to surface tension effects favouring a somewhat spherical shape to minimise energy.

Hence, the ejected "droplets" or "subvolumes" can merge on the nozzle plate or in flight, before they reach the printing substrate. The number of droplets or subvolumes merging into one drop to be jetted on the printing substrate will further be referred to as dpd (droplets per drop). For the sake of clarity, the term droplet as used in the further description of the invention will cover an individual ink volume ejected from the nozzle as well as a subvolume within a string of concatenated volumes of ink ejected from the nozzle.

Figure 8:
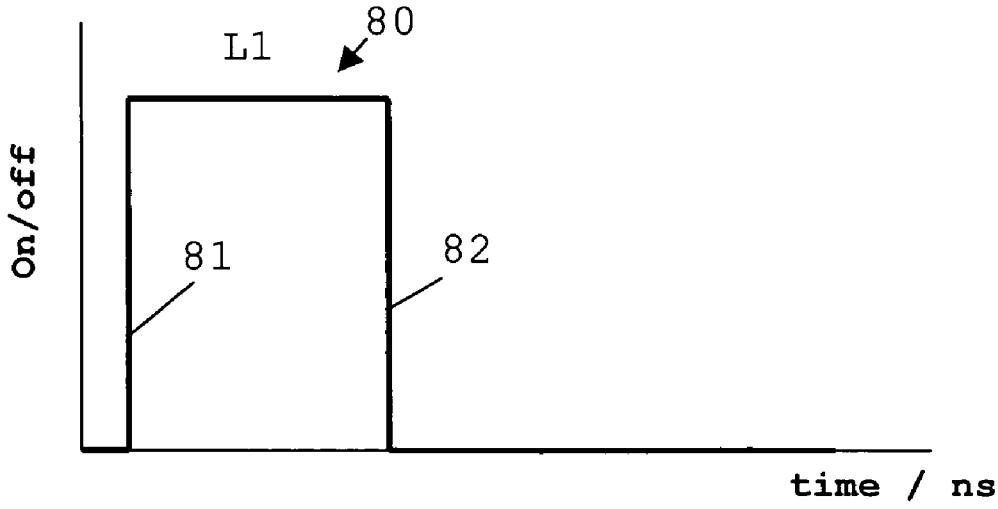
FIG. 8 shows a waveform for creating an ink drop with 1 dpd according to an embodiment of the present invention.

In a first embodiment of the invention a waveform is created for printing at 1 dpd that provides high drop generation frequency resulting in high printing speeds, and stable drop generation resulting in for example reproducible drop volumes and drop velocities. A 1 dpd printing system may also be called a binary printing system. FIG. 8 shows an example of a waveform that is able to create one droplet. The waveform includes one pulse 80 that may have a width L1 and that may be represented with a number of bits depending the width L1 and the sample clock period used.

The pulse 80 includes an opening pulse 81, creating outward bending of channel walls of a chamber so as to engage the pull phase of the chamber, and a closing pulse 82, leading to drop generation and ejection.

In a specific example, the sample clock may be chosen at for example 100 ns. A waveform 80 as shown in FIG. 8 with for example L1=1000 ns and a sample clock of 100 ns may be created by use of the following signal:

| | |
|---|---|
| On: | 0111111111100000000000000000000 |
| Off: | 0000000000000000000000000000000 |
| Ina: | 0000000000000000000000000000000 |

As can be seen, in this specific example, the on-signal requires 10 bits "1" to create a waveform with length 1000 ns.

In fact, any single pulse of any width L1 may be created. This can be done in two ways. In a first way, the sample clock may be changed. If the sample clock is decreased, the width L1 will decrease and if the sample clock is increased, the width L1 will increase. In a second way, the number of bits constituting the pulse may be changed. The more "1" bits used in the waveform signal, the larger the width L1 will be.

In a specific experiment, using the method of the present invention, different single pulse waveform shapes are created by changing the number of bits from 1 to 31. This particular range of available bits to create a waveform pulse, is the result of the use of commercially available drive circuitry for greyscale printheads as described in the Background of the Invention section.

The method according to the invention is however not limited to the use of this type of drive circuitry for greyscale printheads. These waveforms are applied to the printhead channels with different sample clocks of 100 ns, 250 ns, 500 ns and 1000 ns respectively. The length of time L1 may be calculated by multiplying the number of "1" bits used to create the waveform pulse by the sample clock.

For each single pulse waveform thus created and applied to the printhead channels, a number of important operating parameters are registered, e.g. the voltage required to reach a predefined minimum drop velocity, which may for example be 5 m/s, and the maximum voltage and velocity from which point on the drop-generation becomes unstable, i.e. the velocity at which the single drop splits into undesirable individually recognisable volumes. To clarify the latter, it has been found that when the drive voltage is increased with the aim to increase the velocity (the momentum) of the ejected droplet, then from a certain voltage upward the energy in the pressure waves in the ink chamber is high enough to cause unwanted volumes of ink to be ejected from the nozzle at unwanted moments in time.

The unwanted volumes are recognisable as individual spots during flight and on the printed substrate and hence what had been intended to be a single droplet shows on the printed substrate as a split droplet. To perform the above-described experiments, a VisionJet Optica™ system commercially available from Xennia Technologies Ltd. can be used. A schematic representation of a VisionJet Optica system 10 is shown in FIG. 9.

A printhead 11 is installed in VisionJet Optica system 10, is then filled with ink, purged and wiped. The ink pressure at the nozzle plate 12 may be set at a value, for example, between −2 cm water column (=1.96 hPa or mbar) and −50 cm water column (=49.1 hPa or mbar), preferably between −2 and −10 cm water column (=9.81 hPa or mbar) and most preferably between −2 and −4 cm water column (=4.66 hPa or mbar). In the experiment described in this embodiment, the ink pressure at the nozzle plate 12 is set at −2 cm water column or 1.96 hPa. The printhead 11 may be cooled or heated to an appropriate temperature for the ink being used, e.g. a temperature of 25° C.

The creation and flight of drops 13 ejected from the printhead 11 are visualised on a monitor 14 in such a way that field of view of the monitor covers the nozzle plate 12 and a location at 1 mm distance from the nozzle plate 12 towards the printing substrate 15. The monitor 14 is provided with a scale in order to be able to measure the distance of a drop 13 from the nozzle plate 12. A view of a drop in flight is created with a stroboscope technique using a LED synchronised with the drop generation frequency.

At the moment a drop 13 is fired, a means for counting down a time delay 16 is activated. When this time delay expires, the LED 17 is turned on during e.g. 4 μs. This is repeated at the drop generation frequency at which the printhead is driven. The 4 μs exposures, taken at a drop generation frequency, create a visible stroboscope image on the monitor 14. The drop generation frequency may be chosen arbitrarily and can be as high as possible, provided not too many drops are visible within the field of view of the monitor.

A series of drops 13 in quick succession is visible on the monitor as a single drop at a certain distance from the nozzle plate, because the LED 17 always illuminates the individual drops of the series after exactly the same delay time following the generation of the drop at the nozzle. As the time delay for the LED is increased, the snapshots of the individual drops of the series are taken later on in their flight, and the viewed drop on the monitor is at a larger distance from the nozzle plate.

By changing the time delay it is possible to view the drops at different locations along their flight route. Further, by dividing the distance between the view location of the drop and the nozzle plate by the time delay, the velocity of the drops 13 in the series may be determined. Given a specific waveform signal, the velocity of the drops 13 can be controlled with the voltage applied to the printhead channel from where the drops are ejected.

In a specific example of this first embodiment different waveforms with different pulse widths L1 are generated. For every waveform, the voltage required for a drop to reach a predefined minimum velocity, e.g. 5 m/s, is measured. The predefined minimum velocity refers to a suitable minimum drop velocity for high speed printing. This minimum drop velocity can be chosen as a function of the relative velocity of the printhead versus the printing substrate, i.e. the printing speed, and the allowed dot placement tolerances for a targeted image quality. Dot placement errors are amongst others a result of drop flight time variations. With equal drop flight time variations, the higher the printing speed, the larger the dot placement errors will be.

Because absolute drop flight time variations are reduced with higher drop velocity, it is advantageous to use a high drop velocity at high printing speeds. Therefore a predefined minimum drop velocity suitable for high speed printing is chosen as a boundary condition for creation of a waveform.

Using the VisionJet system, the voltage is changed until the 1 dpd drops are visible at a distance of 1 mm from the nozzle plate after a time delay of 200 μs following ejection of the drop at the nozzle. The 1 mm distance is the distance from the nozzle plate to the reference point for the calculation of drop velocity. Indeed, 200 μs flight time for 1 mm flight distance yields 5 m/s. These operating points, waveform pulse width versus waveform voltage to reach a predefined minimum velocity, are set out in a graph (see FIG. 11).

Next, another important parameter is determined for every waveform investigated, i.e. the maximum voltage before the drop generation process becomes unstable and the 1 dpd drop is viewed on the VisionJet system as a split drop. Therefore the stroboscope time delay on the VisionJet system is set at a low value, small enough so that the 1 dpd drops 13 will always be visible, i.e. within the field of view of the monitor, even at the high velocities. The waveform voltage starts at a low value sufficient to create a 1 dpd drop at the nozzle. The voltage is then increased until multiple split volumes are recognisable instead of a single 1 dpd volume.

The drop generation process has become unstable when multiple split volumes are visible. Then the voltage is decreased until again only one drop 13 is visible. The stroboscope time delay is adapted by the time delay generating means 16 until the drop 13 is visible at 1 mm from the nozzle plate 12. The velocity of the drop 13 can then be calculated by dividing the distance of 1 mm=1000 μm by the stroboscope time delay in μs.

Figure 11:
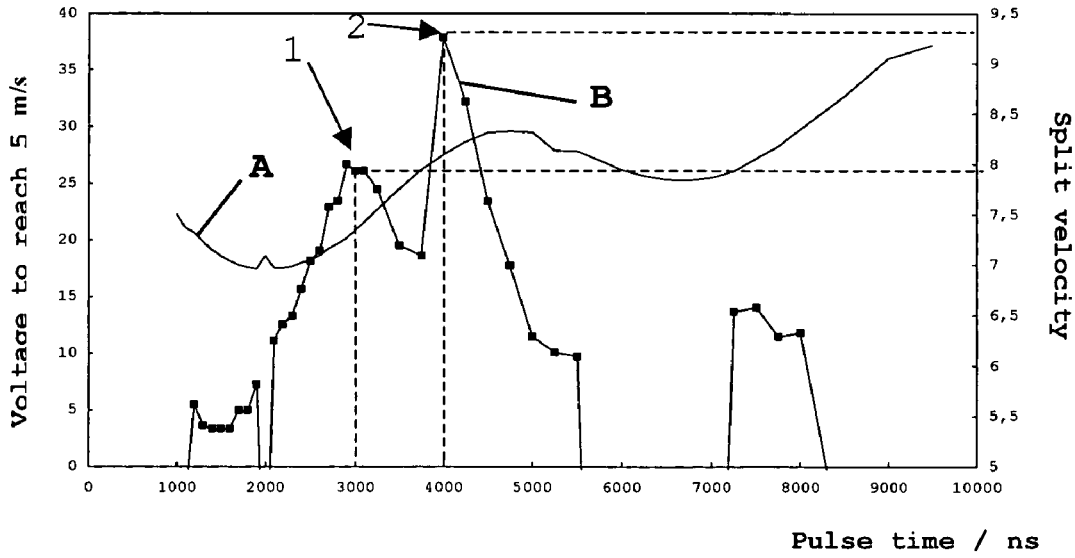
FIG. 11 shows the drive voltage to reach 5 m/s and the drop velocity as a function of pulse width for 1 dpd according to an embodiment of the present invention.

The operating points, waveform pulse width versus maximum waveform voltage and drop velocity without splitting, are set out in a graph (see FIG. 11). The abscissa of this graph is the pulse width L1 (in ns); one ordinate shows the maximum velocity at which the drops 13 do not split, referred to as split velocity; the other ordinate shows the voltage for which the drop 13 has a predefined minimum velocity of for example 5 m/s. From the graph, a waveform is chosen with a pulse width providing a high split velocity (and therefore wide operating window), a small pulse width (enabling high speed printing), and taking into account the voltage required to reach a predefined minimum drop velocity.

In this particular embodiment operating point 1 on the graph of FIG. 11 is selected with a waveform having a pulse width of 3000 ns, a drop velocity operating window up to nearly 8 m/s and a voltage to reach 5 m/s of around 21 V. It can be seen from the graph in FIG. 11 that if the closing pulse 82 of the pulse 80 (FIG. 8) is located after 5500 ns, severe splitting occurs. On the other hand, stable drops are achieved if the closing pulse is between 2000 or 2200 and 4500 ns. As can be seen in FIG. 11 the value of 2000 or 2200 to 4500 ns lies between a first minimum or within 200 ns of the first minimum and about half way between the first and second minima. With "minimum" is meant a significant minimum and not merely local oscillations. Without being limited by theory, the frequency defined by the minima in this curve may equal twice the resonant frequency of the ejection system.

For printheads which conform with the aboveinterpretation, the value of 2000 to 4500 ns is a time period defined by being between about one quarter and one half of the inverse of the resonant frequency from the start of the pulse.

In a second embodiment of this invention a method is described for making a waveform which creates larger drops including different droplets that merge on the nozzle plate 12 or in flight before hitting the printing substrate 15. In this embodiment, a waveform is generated optimising the velocity of the ink drops such that ink drops with different numbers of merged droplets have substantially the same velocity. If such multiple droplet drops with substantially equal velocity are ejected from different nozzles at substantially the same time, and travel the same distance to the printing substrate 15 they will land on the printing substrate after substantially the same time of flight.

In scanning printhead applications, with a relative movement between the printhead and the printing substrate, controlling the time of flight is crucial in ensuring a correct landing position of the drops, i.e. a correct dot positioning.

By way of example, the method described in this second embodiment of the invention may use a commercially available drive circuitry for greyscale printheads, as described in the section 'background of the invention', having 480 bits available for a waveform signal generating multiple droplet dots. In the following description, L1 denotes the width of the pulse to create a first droplet. Similarly, L2 to L15 represent the width of the pulse to create the second to the fifteenth droplet of the merged multiple droplet drop.

According to this second embodiment, firstly, the method described in the first embodiment is executed resulting in a specification of the pulse width L1 for which a high and stable 'non-splitting' velocity can be achieved higher than the predefined minimum velocity, taken into account the voltage necessary to reach that predefined minimum velocity, e.g. 5 m/s.

In a next step, waveforms are created with the chosen pulse width L1, while pulse width L2 of the second pulse and the time between L1 and L2, denoted by P12, are varied. This waveform is a so-called 2 dpd waveform generating two droplets per dot. The split velocity and voltage to reach the predefined minimum velocity of for example 5 m/s are displayed in a graph as a function of the values L2 and P12.

In normal printhead operation, commercially available drive circuitry as described in the section 'background of the invention' outputs only one common voltage to drive all connected printhead channels, consequently imposing voltage constraints on the 1 dpd and 2 dpd waveforms being considered, i.e. the voltage used to drive both waveforms in normal operation needs to be the same. Therefore, a combination of L2 and P12 for the 2 dpd waveform is chosen so that on the one hand the waveform duration, i.e. the time of L1+P12+L2, is as small as possible to enable high speed printing, and on the other hand the waveform has a high split velocity thus creating a large operating window, but provided that the difference between the voltage of the already specified 1 dpd waveform to reach a predefined minimum drop velocity (see FIG. 11) and the voltage of the 2 dpd waveform to reach the same predefined minimum velocity (see FIG. 13) is minimal.

Although the normal operating point of the printhead can be chosen to be at a drop velocity higher than the predefined minimum drop velocity, when the voltage difference between a 1 dpd waveform and a 2 dpd waveform at this predefined minimum drop velocity is minimal, the voltage difference will also be minimal at other drop velocities because drop velocity increases linear with voltage within normal operating conditions of the printhead.

Key for the determination of the waveform parameters L2, P12 and V is that the drop velocity for the 1 dpd waveform and for the 2 dpd waveform be the same. Tradeoffs may have to be made in order to come as close as possible to this key target.

Subsequently, waveforms are created with the chosen L1, P12, L2 while L3 and the time between L2 and L3, denoted as P23 are varied. Again, the values of L3 and P23 are chosen such that the voltage difference between the already specified 1 dpd waveform and a 3 dpd waveform for both to generate drops with a predefined minimum velocity, e.g. 5 m/s, is as small as possible, the split velocity of the 3 dpd drop is as high as possible, and the total waveform duration is as small as possible. The above-described steps may be repeated until all the waveforms are specified, i.e. until the waveform for the maximum required droplets per dot for the targeted print resolution is specified.

Using the method of the present invention, as illustrated in this second embodiment, the drop velocity of drops of different volumes is optimised by determining the length $L_N$ of each pulse and the time $P_{(N-1)(N)}$ between two subsequent pulses. In this drop velocity optimisation, the target drop velocity is above 5 m/s, more preferably above 7 m/s and most preferably above 9 m/s. In general, the length of each pulse and the time between two subsequent pulses may be different for each value of N. The advantage of the method is, that by designing each pulse individually, the surplus of energy gradually built up in the ink channel of the printheads according to the prior art is avoided. This may be important for printheads to which only one drive voltage can be applied and hence for which the input of energy into the channel cannot be controlled by adapting the voltage of each pulse of the waveform applied. However, in a specific case, the length of each pulse and time between two pulses may turn out to be the same after applying the method according to this invention.

In a specific, but not limiting, example of the second embodiment, illustrated in FIG. 10 to 17 a waveform is created, meant for writing images at 720 dpi. Drop volumes up to 4 dpd will be used. The 4 dpd waveform shape will look like FIG. 10 with each pulse generating a droplet or a subvolume of ink. In this example, an Agfa research ink jet printhead D298, with a similar technology and construction as the commercially available Leopard™ printhead from Xaar, is used and Agfa Sherpa™ Dye M (LDQBQ) ink. It is important to notice that this type of ink is only used as an example and is not limiting for the invention, as is this particular printhead.

Other type of inks may be used, as well as all suitable material that can be printed on. The printhead used in this example includes 764 nozzles. The sample clock is chosen to be 100 ns and the printing frequency for determining the waveforms is 100 Hz. Experiments are carried out at a constant temperature of about 27° C.

In a first step, the ideal length of L1 is determined using one of the nozzles of the printhead. During the experiment, the pulse width L1 is varied between 1000 and 9500 ns. The split velocity and the voltage to reach the predefined minimum velocity, e.g. 5 m/s, are measured as a function of L1. In FIG. 11 the voltage to reach 5 m/s (curve A) and the split velocity (curve B) are shown as a function of the pulse width L1.

Analysing FIG. 11, it is clear that two possible values can be chosen for L1 in order to achieve a wide operating window without drops splitting, i.e. 3000 ns in point 1 and 4000 ns in point 2. Because point 2 takes a higher voltage (28 V) and a longer waveform (4000 ns), the first maximum, i.e. point 1 is chosen. The length of L1 is thus determined to be 3000 ns. In this point the required voltage for a predefined minimum velocity of 5 m/s is 21 V.

In a next step, a waveform is created which is able to print 2 dpd. The width of the first pulse is set at 3000 ns as already determined in the first step of the method. Then, the length of P12, i.e. the delay between the first and the second pulse, is changed between 1200 ns and 2000 ns in steps of 200 ns, and for each value of P12, L2, i.e. the width of the second pulse, is changed between 1000 ns and 3700 ns with intervals of 100 ns.

Figure 12:
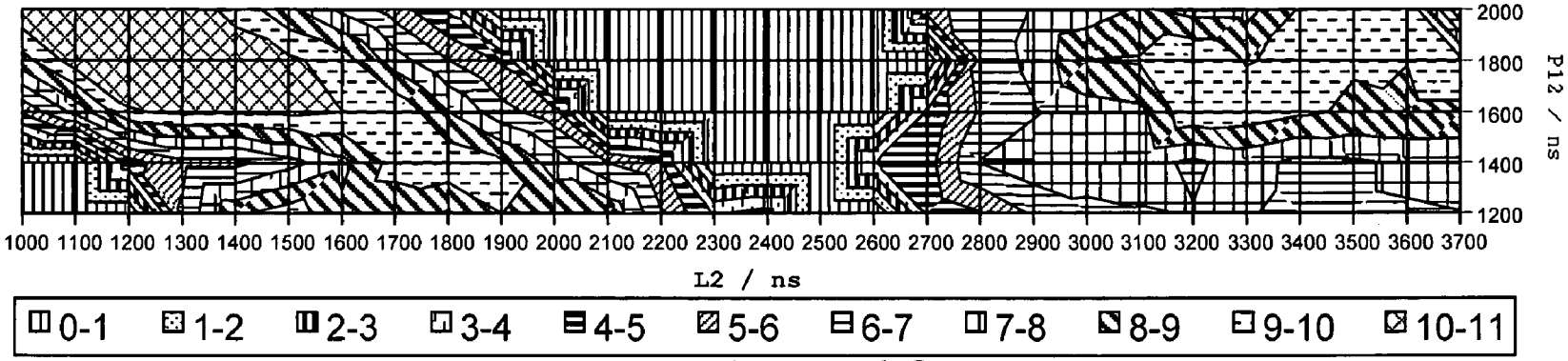
FIGS. 12, 14 and 16 show the maximum velocity at which individual droplets still merge into one drop, as a function of different combinations of the pulse width and the delay time between succesive pulses for respectively, 2 dpd, 3 dpd and 4 dpd according to an embodiment of the present invention.
Figure 13:
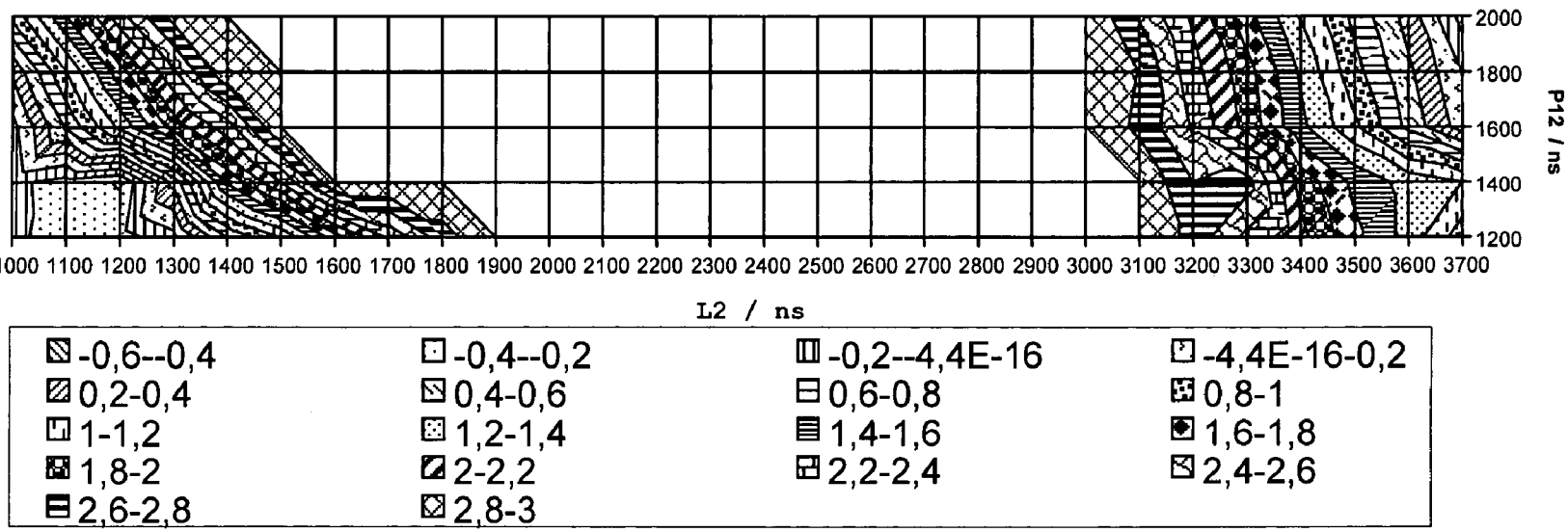
FIGS. 13, 15 and 17 show the voltage difference between a waveform for an xdpd drop to reach 5 m/s and a waveform for an (x-1) dpd drop to reach 5 m/s, as a function of different combinations of the pulse width and the delay time between successive pulses for respectively 2 dpd, 3 dpd and 4 dpd according to an embodiment of the present invention.

FIG. 12 shows the split velocity for the 2 dpd drop, i.e. the maximum velocity for which the droplets still merge into one drop before striking the printing substrate, for the combinations of L2 and P12. In FIG. 13 the difference in voltage to reach a predefined minimum velocity of for example 5 m/s between the 1 dpd drop already determined and a 2 dpd drop for the different combinations of L2 and P12, is shown. A selection of a suitable value for P12 and L2 is based on a voltage difference between the 1 dpd and the 2 dpd waveforms that is as small as possible, because in practice printhead drive circuitry often only allow one drive voltage to be used for all types of waveforms, and a split velocity as high as possible, because this provides a wide operating window.

From FIG. 12 it can be seen that the highest velocity at which droplets still merge is when the point with co-ordinates (L2, P12) is positioned within the region with the rhombus marks where a velocity of 10 to 11 m/s can be achieved. However, when comparing with FIG. 13, the point (L2, P12) should have an as small as possible voltage difference between the 1 dpd waveform and the 2 dpd waveform for both to reach the predefined minimum velocity. In FIG. 13 this region is identified with the vertically striped marks for which the voltage difference between the 1 dpd waveform and the 2 dpd waveform is only between 0 V and 0.2 V. However, for combinations of P12 and L2 in this region, the maximum velocity at which the 2 droplets still merge is less than the predefined minimum velocity of 5 m/s. Therefore, a compromise has to be made between these two conditions. Hence, the values for L2 and P12 are chosen to be respectively 1100 ns and 1700 ns for which the maximum velocity at which the 2 droplets still merge is about 9 m/s and the voltage difference between the 1 dpd waveform and the 2 dpd waveform is only 0.8 V.

The above means that, during printing, when driving the printhead with the waveforms designed according to the present invention, first a first opening pulse 81 for the ink chamber will be generated, thus loading the ink chamber with ink. Thereafter a second closing pulse 82 will be generated, which is located in the range starting at the first minimum in FIG. 11 or within 200 ns of this mumnimum up to half way to the next minimum in curve A. Thereafter a next or third opening pulse will be generated, located at a position between half way between the minima and the second minimum in curve A. Without being limited by theory, the frequency defined by the minima in this curve A may equal twice the resonant frequency of the ejection system.

For printheads which conform with the above interpretation, the second closing pulse is located at about one quarter to one half of the resonance period of the ink chamber to thereby eject a drop. Thereafter a next opening pulse will be generated, located at a position between half and three quarters of the resonance period of the ink chamber.

Figure 14:
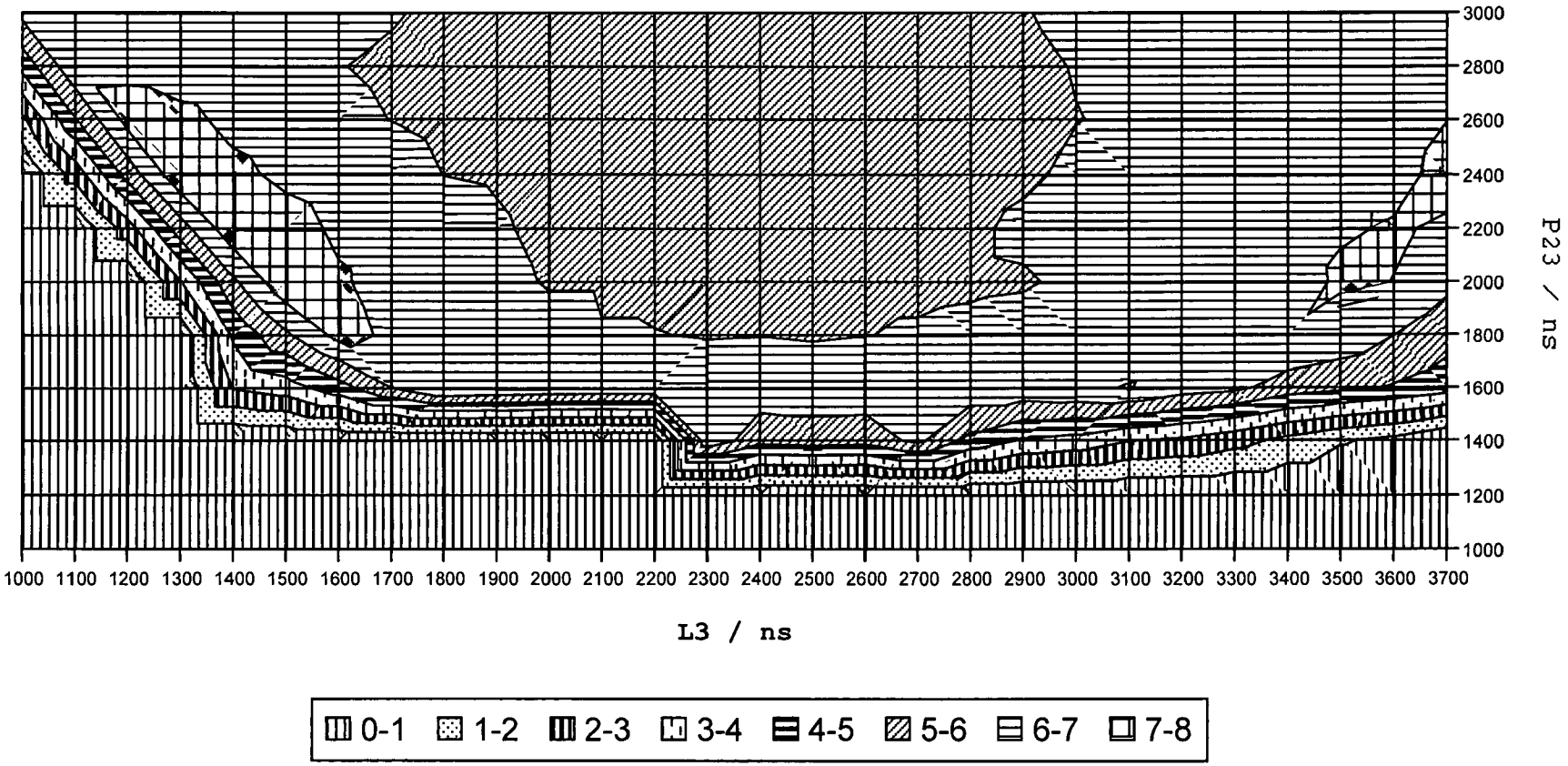

In a third step, waveforms are created with L1=3000 ns; P12=1700 ns and L2=1100 ns. The pulse width L3 is varied between 1000 and 3700 ns and the time between the second pulse L2 and the third pulse L3, i.e. P23, is varied between 1000 and 3000 ns. FIG. 14 shows the maximum velocity at which the 3 droplet merge into 1 drop for different combinations of L3 and P23, and FIG. 15 shows the difference in voltage to reach the predefined minimum velocity of 5 m/s between the 2 dpd waveform and the 3 dpd waveform for different combinations of L3 and P23.

Figure 15:
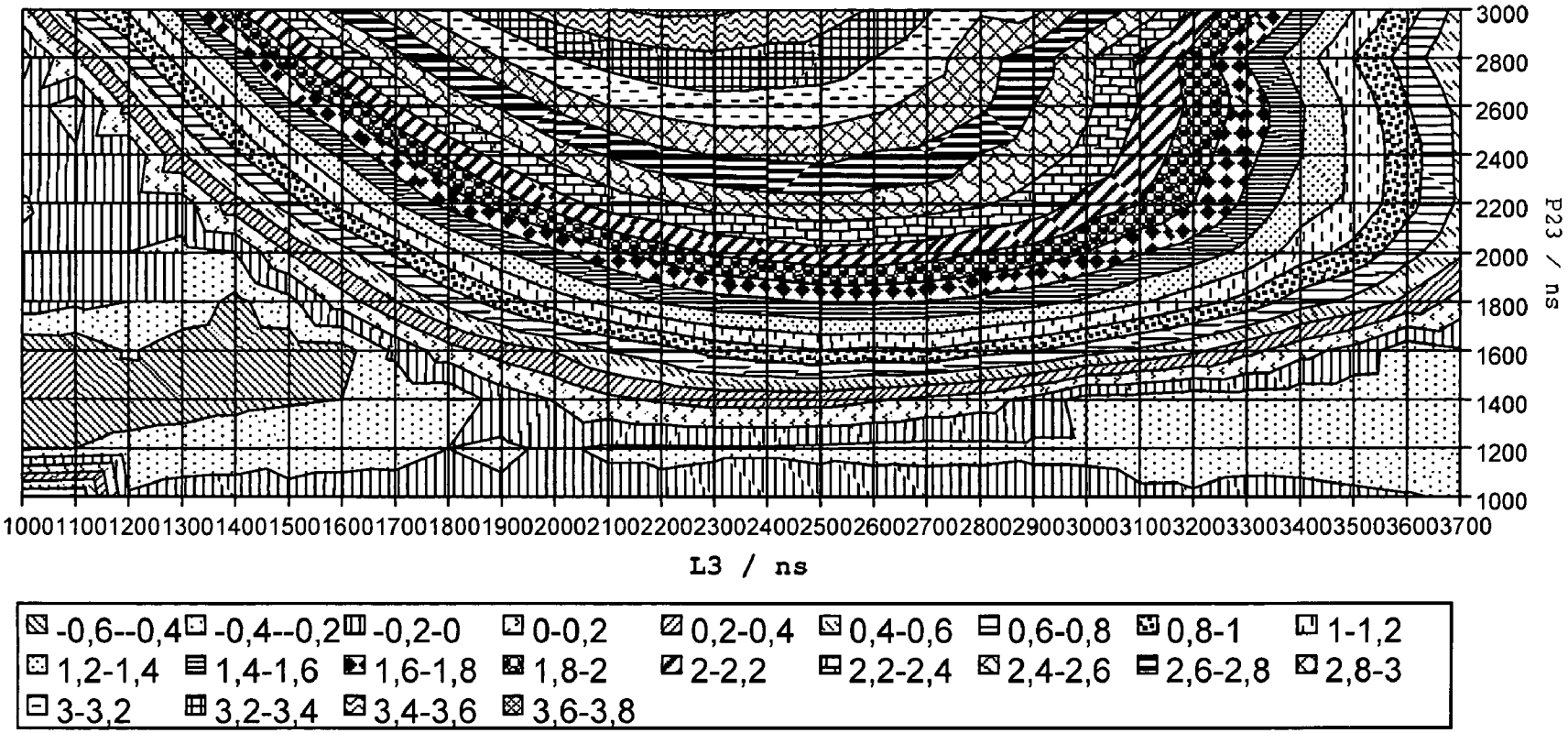

From both FIGS. 14 and 15 it can be seen that it is now possible to choose a point with co-ordinates (L3, P23) for which both a maximum velocity and a minimum voltage difference can be achieved. The values of L3 and P23 are chosen to be respectively 1500 ns and 2000 ns. For these conditions the maximum velocity at which the droplets merge is 7 to 8 m/s and the difference in voltage to reach the predefined minimum velocity of 5 m/s between the 2 dpd waveform and the 3 dpd waveform is 0.2 V.

In this third step of the method, the voltage to reach a predefined minimum velocity for the 3 dpd waveform is compared with de settings of the 2 dpd waveform determined in the second step of the method. The method could also refer to the voltage settings of the 1 dpd waveform determined in the first step of the method. In fact, this embodiment of the present invention minimises the voltage difference between all waveform that are required to print, and maximises the split velocity for all the waveforms.

In a last step for this specific example, 4 dpd waveforms are created with values L1=3000 ns; P12=1700 ns; L2=1100 ns; P23=2000 ns; L3=1500 ns, and varying values for the pulse width L4 of the forth pulse between 1000 and 3700 ns, and varying delay times P34 between the third and the forth pulse between 1000 and 2000 ns.

Figure 16:
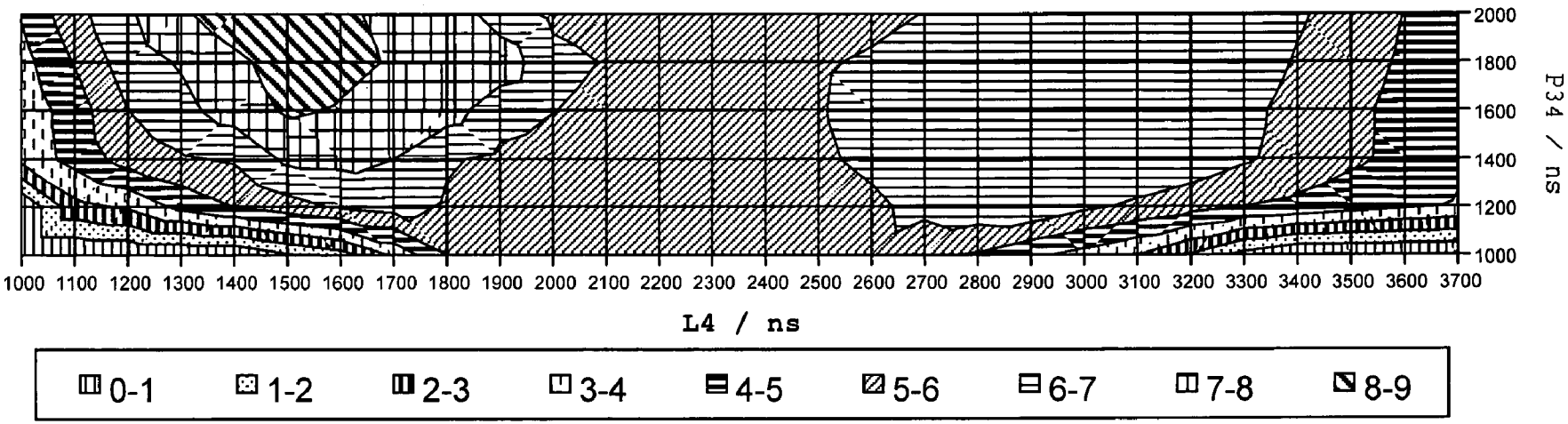
Figure 17:
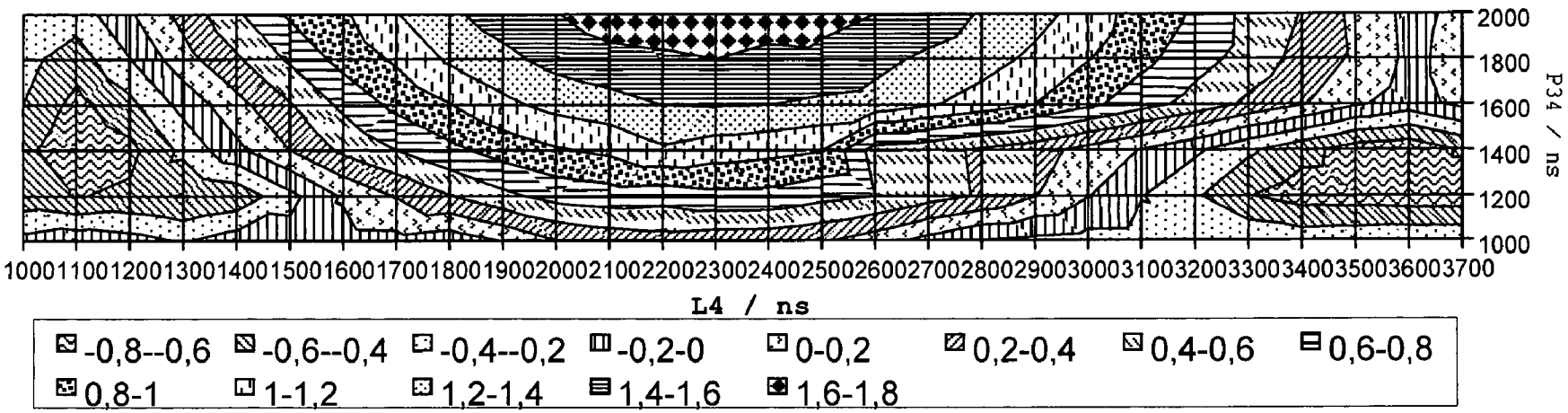

FIG. 16 shows the maximum velocity at which the droplets merge for different combinations of L4 and P34. FIG. 17 shows the difference in voltage to reach a predefined minimum velocity of for example 5 m/s between the 3 dpd waveform determined in the previous step and the 4 dpd waveform for different combinations of L4 and P34.

In the same way as described in the above steps, L4 and P34 may be determined from FIGS. 16 and 17. Values of 1500 ns for both L4 and P34 are chosen. For these conditions a maximum merging velocity of 7 to 8 m/s and a voltage difference between the 3 dpd waveform and the 4 dpd waveform of 0.3 V is achieved. As described above, in this step of the method one could also refer to the voltage settings of the 1 dpd waveform determined in the first step. In fact, this embodiment of the invention minimises the voltage difference between all waveform that are required to print, and maximises the split velocity for all the waveforms.

In this second embodiment of the present invention, the method provides a set of waveforms at 100 Hz which complies with the conditions of merging with a maximum velocity of 7 to 8 m/s or more and a voltage difference between all waveforms of 1.3 V or less. By using waveforms created according to the method of the present invention, even with application of a single drive voltage for all waveforms, drops 13 including different number of droplets have substantially the same velocity, and therefore arrive at the printing substrate 15 at substantially the same time, within a tolerance of 25%, preferably within a tolerance of 10%, and most preferably within a tolerance of 4%.

In order to make the compromises as described above, a Pareto analysis can be applied. According to an embodiment of the present invention, a trade-off has to be made between at least two of a plurality of parameters. For example, on the one hand, pulse duration should be as short as possible in order to enable fast printing, on the other hand, different pulse widths or pulse durations lead to different split velocities, i.e. different maximal velocities at which drops do not split, and thus longer pulse widths may be preferred for that reason.

Drop velocity has to be as large as possible in order to have a printing speed as high as possible. But driving voltage, which is directly related to drop velocity, should be as low as possible for energy consumption reasons, and needs to remain below a maximum value at which split drops are generated. Furthermore, the difference between driving voltages of multiple droplet waveforms to reach a pre-defined minimal drop velocity, should be minimal. Due to the presence of a plurality of constraints, the trade-off to be made is difficult.

In order to optimise the trade-off, a multidimensional cost function, or a plurality of interrelated cost functions can be established. These can be represented by Pareto-curves which indicate the point(s) in the search space where a (set of) cost(s) is optimal relative to a (set of) constraint(s). One example of such Pareto-curve, relating the inverse of split velocity to the difference in driving voltage between a 1 dpd drop and a 2 dpd drop to reach a predefined minimum velocity, is given in FIG. 24. It is desired to, at the same time, have the split velocity as high as possible, or thus the inverse of the split velocity as low as possible, and the voltage difference as low as possible as well, i.e. move on the Pareto curve left and down.

The area of the graph close to the origin are operating points which cannot be reached. The area of the graph above the curve represents non-optimal operating points. Points on the curve define the boundary between possible but non-optimal points and impossible operating points. Non-optimal points in the search space that are "dominated" by other points should not be considered for subsequent implementation.

Figure 24:
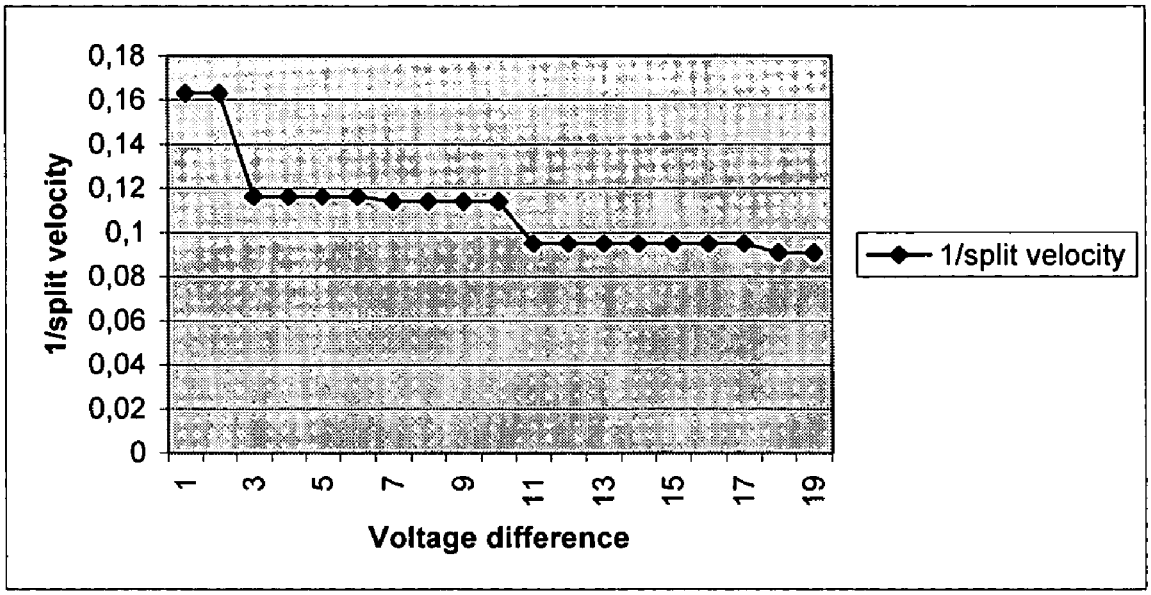
FIG. 24 illustrates a Pareto-curve, relating an inverse of split velocity to a difference in driving voltage between a 1 dpd drop and a 2 dpd ink drop to reach a predefined minimum velocity.

This method is a specific embodiment of one aspect of the present invention which relates to selecting an optimised trade-off. The method of selecting a trade-off may be based on the well-known Pareto analysis. FIG. 24 is an example of determining a plurality of combinations of a first printing parameter and a second printing parameter, the combinations of printing parameters defining operating points of a printhead or printing device, the combinations belonging to a trade-off set, wherein for any one combination of parameters for an operating point, all other combinations of printing parameters for all other operating points in the trade-off set having a value of the first printing parameter which is less favourable than the value for the one combination, have a value for the second parameter which is more favourable than the value of the second parameter of the one combination, and all other combinations of printing parameters for all other operating points in the first trade-off set having a value of the first parameter which is more favourable than the value for the one combination, have a value for the second parameter which is less favourable than the value of the second parameter for the one combination.

More favourable means that a value in FIG. 24 is lower either along the x or the y axis or both. The combinations of the trade-off set lie on the line drawn linking the points in FIG. 24. The first parameter may be selected from at least one ink ejection parameter selected from the group of drop velocity, difference in drop velocity, drive voltage, number of split drops, split velocity or drop placement error. The second parameter may be selected from a parameter relating to printing speed, e.g. printing speed itself, or the time duration $L_N$ of each pulse and the time $P_{(N-1)(N)}$ between two subsequent pulses, which time duration will have an effect on printing speed.

The inverse of any parameter may also be used. The final step is then to select a combination of first and second parameters having values within 15% of an operating point defined by a combination in the trade-off set. In other words although the trade-off set includes points on the line dividing the possible from the impossible or practical, points away from this line in the possible area may still be suitable for practical use even though it is away from the optimal trade-off set. The degree of tolerance may be a deviation of 5%, 10%, 15% or 20% from the optimal operating points of the trade-off set.

The above optimisation is carried out at fixed droplet size. However, the present invention is not limited thereto. The trade-off optimisation may be performed for droplet size as well. In this case greyscales can be obtained by varying the size and the number of droplets in each drop. This adds a further dimension to the optimisation. In this case the Pareto analysis results in a multidimensional surface optimised by determining a plurality of combinations of at least a first printing parameter, a second and a third printing parameter, the combinations of printing parameters defining operating points of a printhead or printing device, the combinations belonging to a trade-off set, wherein for any one combination of parameters for an operating point, all other combinations of printing parameters for all other operating points in the trade-off set having a value of the first printing parameter which is less favourable than the value for the one combination, have a value for the second or third parameter which is more favourable than the value of the second or third parameter of the one combination, and all other combinations of printing parameters for all other operating points in the first trade-off set having a value of the first parameter which is more favourable than the value for the one combination, have a value for the second and third parameter which is less favourable than the value of the second or third parameter for the one combination.

Because the predefined minimum velocity, used in the method of the present invention to minimise drive voltage differences between different waveforms, refers to a minimum velocity for high speed printing, it is an advantage of the present invention that the waveforms are optimises for high speed printing operation. Another advantage of the present invention is that, through a more uniform drop velocity, a better positioning of the ink drops on the printing substrate is achieved.

The tolerance on positioning of the ink drops onto the printing substrate is a very important measure for print quality and may for example be not more than ±41 μm. Preferably, the tolerance is less than ±13 μm and most preferably the tolerance is less than ±5 μm. The method of the invention may thus be used for creating waveforms to achieve printing at a predefined minimum velocity whereby the printing velocity is substantially the same for drops including a different number of droplets. In the above embodiment, a reference voltage of e.g. 5 m/s was given as an example.

However, the method of the present invention may also be used for creating waveforms for printing at lower velocities. It has to be said that when high printing velocities are required, very likely compromises have to be made between the allowable voltage difference between waveforms of different dpd and a high split velocity, as described in the above embodiment. The lower the required printing velocity is, and therefore the minimum drop velocity, the more working points are available and the less compromises have to be made.

It might even be possible to find a solution without making any compromises because an unequivocal point may be achieved, i.e. the required minimum printing velocity may be achieved at the same voltage for all the different waveforms with split velocities significantly higher than the required minimum printing velocity.

While the previous embodiments of the present invention develop different greyscale waveforms based on the behaviour of a single nozzle and use the resulting waveform parameters for all the nozzles of the printhead, a further embodiment of the method according to the present invention may investigate the behaviour of all or a subset of nozzles of the printhead.

In this case, instead of investigation the behaviour of a nozzle by means of a VisionJet system, a test pattern is printed with all or a subset of nozzles and the print quality is evaluated. Two ink ejection parameters are preferably taken into account, e.g. the number of split drops visible on printing substrate and the deviation $\Delta y_{av}$, where $\Delta y_{av}$ is the average dot position error on the printing substrate in the printing direction. Again, the pulse widths $L_N$ and the time between two subsequent pulses $P_{(N-1)(N)}$ may be chosen to optimise the ink ejection parameters.

In a first step, the pulse width L1 and voltage V of a waveform to print at 1 dpd dot may be determined. Therefore, printing experiments are performed whereby a series of voltages are combined with different pulse widths, e.g. for each pulse width value L1, dots are printed at different voltages V. A combination of L1 and V at which a good printing quality is achieved, i.e. at which only a small number of split drops are visible on the printing substrate and at which the deviation $\Delta y_{av}$ is as small as possible, may be chosen as the 1 dpd working point at which the printhead will be set to later print complete images.

Figure 18:
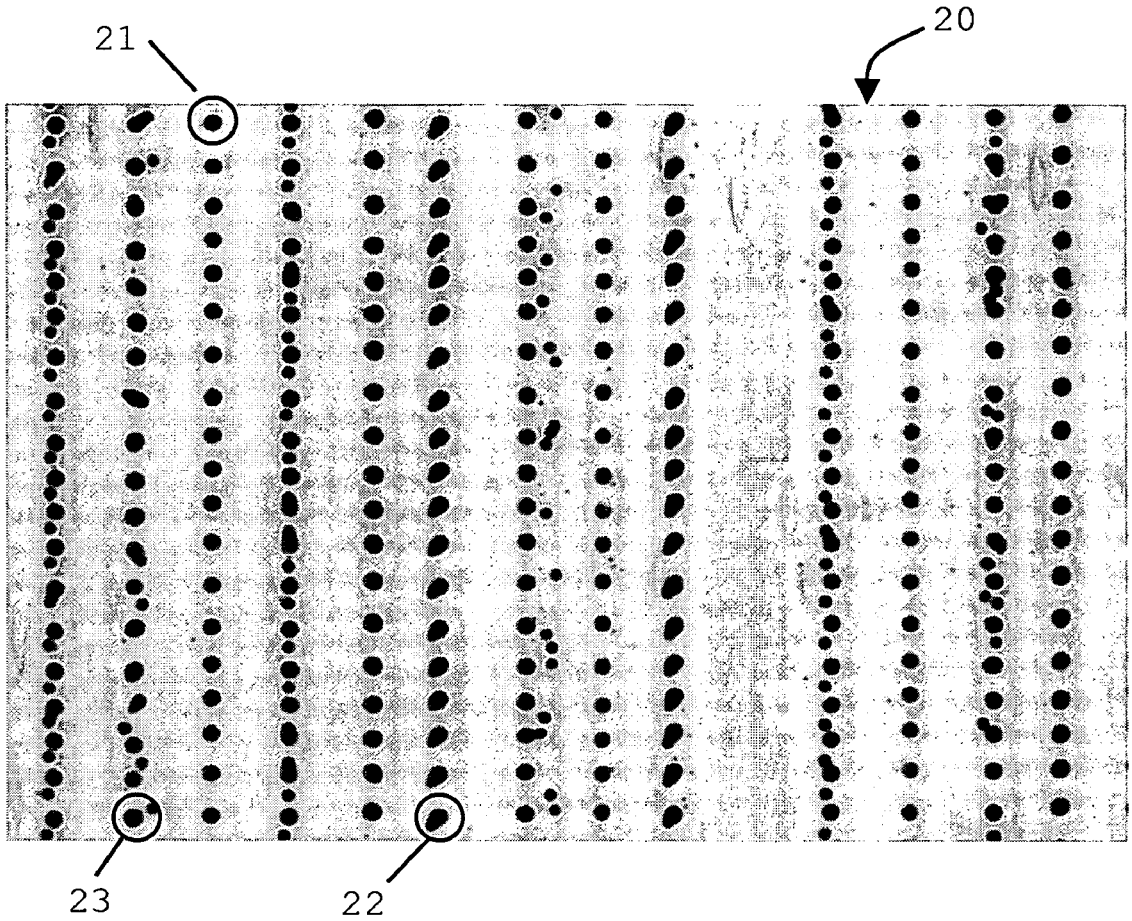
FIG. 18 shows an image of raster of dots printed with a printhead at a certain waveform pulse width L1 and a certain potential V.

To determine the amount of split drops via printed test patterns, the following procedure can be followed. For each combination of a value L1 and a voltage V a raster 20 of ink dots 21 is printed, as can be seen in FIG. 18. Ink dots 21 are formed by an ink drop ejected from the printhead and landing on the printing substrate. Dots on a vertical line are printed from a single nozzle. Dots on a horizontal line are printed by different nozzles of the printhead.

A split drop may be visible on the printing substrate by a dot not having a circular shape, e.g. an oval shaped dot 22 or a dot 23 having little splashes or satellites surrounding it. The number of split drops that is visible in the raster 20 is then counted for each combination of L1 and V. This number is an indication for the number of nozzles that do not work properly at that particular combination. The number of split drops is then displayed in a graph as a function of L1 and V, and a minimum is sought. This procedure can be automated with the aid of image analysis software tools as available from ImageXpert or QEA. These software tools perform enhanced image processing algorithms on scanned printed test pattern.

Figure 19:
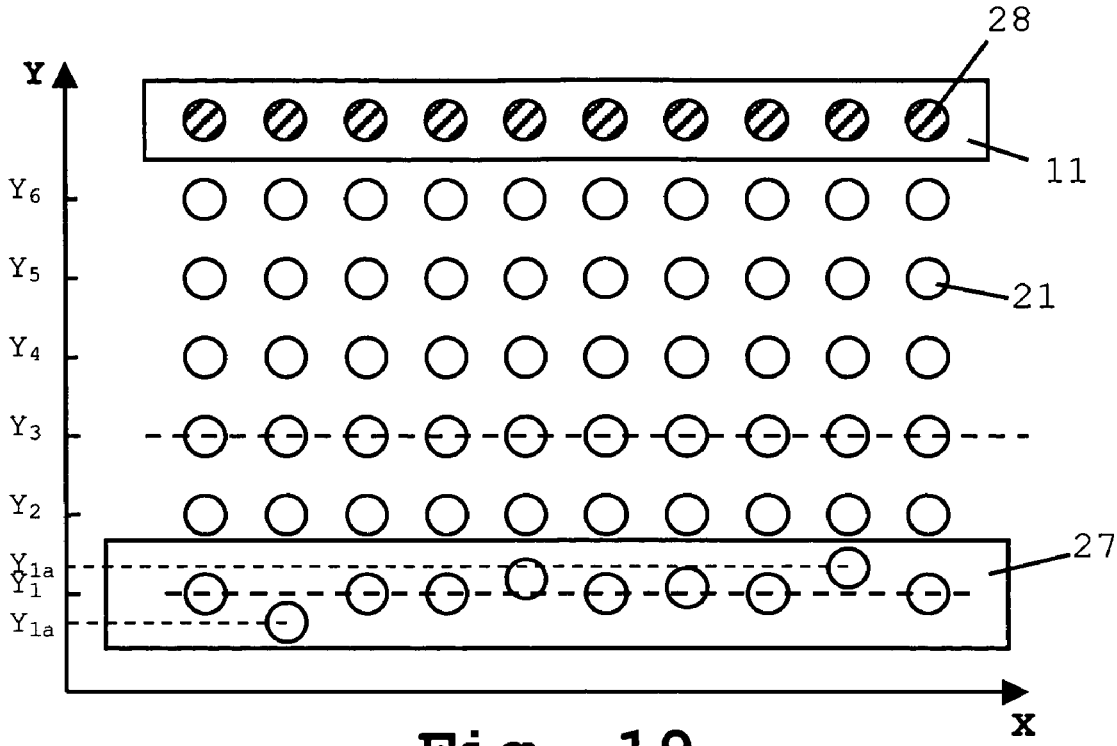
FIG. 19 shows a raster of dots.
Figure 20:
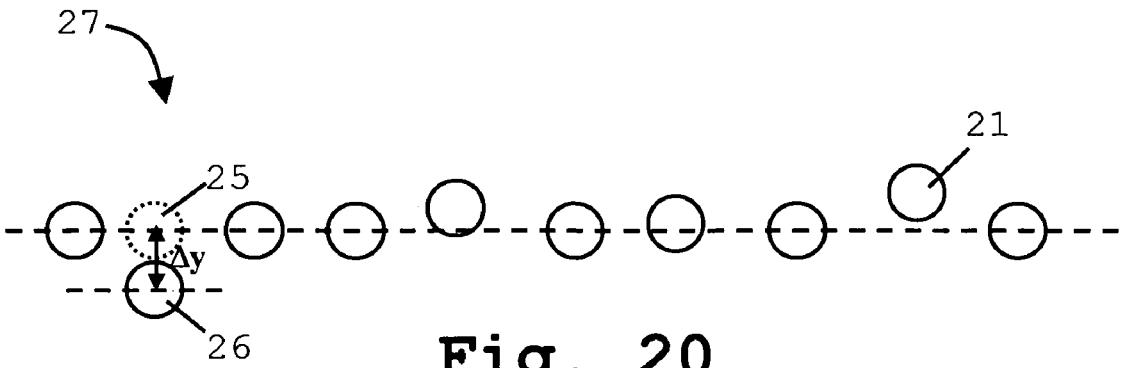
FIG. 20 illustrates the deviation Δy for an ink drop in a certain row of a raster of dots.

A further ink ejection parameter which is preferably optimised in this first step and is linked to the overall print quality is the distance between the actual landing position 25 of a dot 21 and its corresponding target position 26 (see FIGS. 19 and 20). In the description of this invention this will be referred to as the dot placement error Δy along the printing direction. FIG. 19 shows a raster of dots including different rows 27 of dots 21 which have been ejected from the nozzles 28 of a printhead positioned according.

Ideally, dots 21 ejected from different nozzles of the printhead at the same time, will be positioned in the same row 27 and all have the same y co-ordinate $y_i$, whereby i is an integer that indicates the number of the row 27 in which the dot 21 is positioned. For example, $y_1$ is the y co-ordinate for the first row 27 of dots 21 printed by the printhead.

However, in practice, the different dots 21 in a same row 27 may show different y co-ordinates, e.g. $y_{ia}$, $y_{ib}$, . . . , as is illustrated in FIG. 20. The deviating positions of dots 21 in a same row 27, i.e. the deviating positions of dots 21 ejected from the printhead at substantially the same time, can be the result of different drop velocities for the drops corresponding to dots 21.

Having different velocities, the drops reach the printing substrate at different point in time and thus at different places on the printing substrate. The difference between the actual position 26 of a dot 21 and its corresponding target position 25 in the printing direction is denoted as the dot placement error Δy in the printing direction. It is advantageous to keep this dot placement error Δy as small as possible.

In order to determine the waveform parameters L1 and V that provide, averaged over the full set or part of nozzles of the printhead, the least dot placement error in the printing direction, raster of dots like in FIG. 19 are printed for different pulse widths L1 and at different voltages V. For each dot 21, the deviation Δy is determined and then, an average value of Δy, further referred to as $\Delta y_{av}$ for the complete raster is calculated. For this calculation, again image analysis software tools as available from ImageXpert™ or QEA can be used.

The enhanced image processing algorithms used for this purpose calculate the centre of gravity for every dot and compare these co-ordinates with the target co-ordinates for that particular dot. The average dot placement error number $\Delta y_{av}$ is then displayed in a graph as a function of L1 and V, and a minimum is sought. The combinations of voltage V and pulse width L1 for which the average dot placement error $\Delta y_{av}$ is as small as possible may then be compared with the voltage V and pulse width L1 for which the amount of split drops is as small as possible, as described earlier in this step of the method in this embodiment. A solution for L1 and V satisfying both criteria may not be available and a quality compromise may be necessary to come to a solution. Therefore, instead of comparing the minima for the two ink ejection parameters being optimised, threshold values may be used.

A first set of solutions (L1, V) for which the number of dots in the raster show split drops is below a first threshold value is then compared with a second set of solutions (L1, V) for which the number of dots in the raster that show a dot placement error below a predefined value is below a second threshold value. These threshold values are predefined and are related to the print quality target. The threshold values used in this first step, but even so in later step of the method, may for example be 10% of the dots in the raster, more preferably 5%, most preferably 1%.

Figure 21:
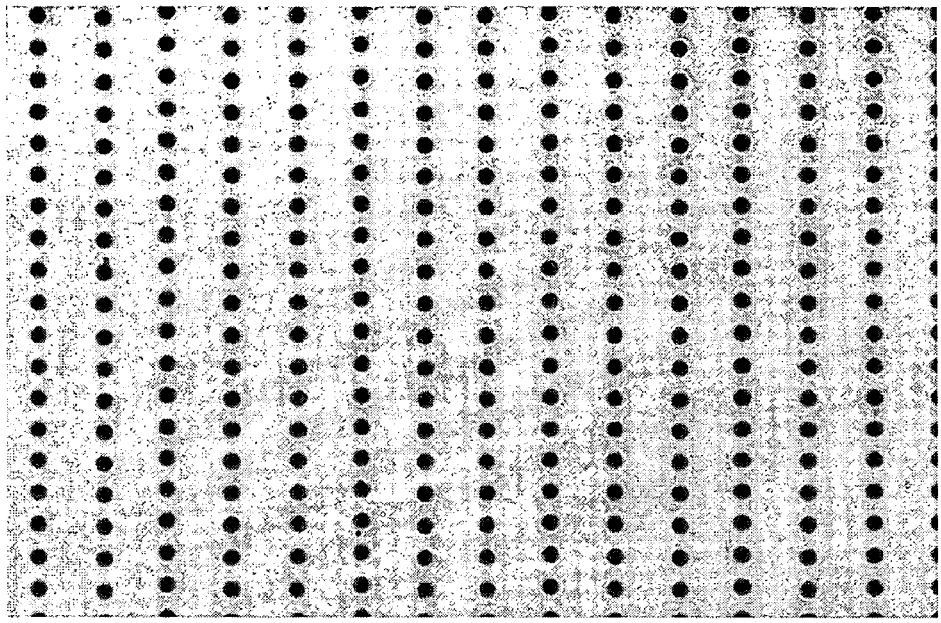
FIG. 21 shows a raster of dots, printed with a pulse with a voltage V and width L, wherein the number of split drops and the average deviation have been optimised.

As a quality check, the chosen values of pulse width L1 and voltage V may be applied to the printhead to print a raster of dots to verify the final image quality, as for example shown in FIG. 21. In a second step of the determination of waveform parameters based on imagewise optimisation of ink ejection parameters, similar experiments as described to determine the 1 dpd waveform are now performed for 2 dpd waveforms.

The pulse width L1 is known from the first step and the pulse width L2, the time P12 between the pulses L1 and L2, and the voltage have to be determined. A set of test patterns or dot rasters, as in the first step of this embodiment of the present invention, is printed with various combinations of the parameters L2, P12 and V, is made and analysed for number of split drops and average dot placement error in the print direction. The combination of L2 and P12 is chosen for which the waveform voltage V is as close as possible to the voltage derived for the 1 dpd waveform in the first step of this embodiment, and for which the print quality is optimal or within a print quality threshold, i.e. number of split drops and average dot placement error in print direction as small as possible or below a predefined quality threshold.

The same steps may then be repeated for other dpd waveforms, until the required waveforms are completed. In this way, waveforms for printing with a high image quality at different grey levels may be formed.

In the case commercially available drive circuitry for driving greyscale printheads may have a restriction to use only one operating voltage V for all the waveforms applied to a printhead, the method of the present invention may be simplified. Because only one waveform voltage can be used in normal printhead operation, this voltage needs to be determined only once, for example in the first step of the method when the 1 dpd waveform parameters are determined.

In later steps, i.e. when determining parameters for the higher dpd waveforms, the voltage is no longer a parameter to be determined but a pre-set value. This reduces the number of experiments that need to be executed, the number of test pattern to be printed, the number of graphs to drawn and interpreted, etc. The determination of a single waveform voltage that is to be used for all dpd waveforms applied to the printhead can also be based on 2 dpd waveform experiments instead of 1 dpd waveform experiments. This is because a 2 dpd waveform may be more representative for other dpd waveforms than is the 1 dpd waveform. A 1 dpd waveform may be somewhat special because it does not require merging of multiple droplets before the ink strikes the printing substrate as a single drop.

Figure 22:
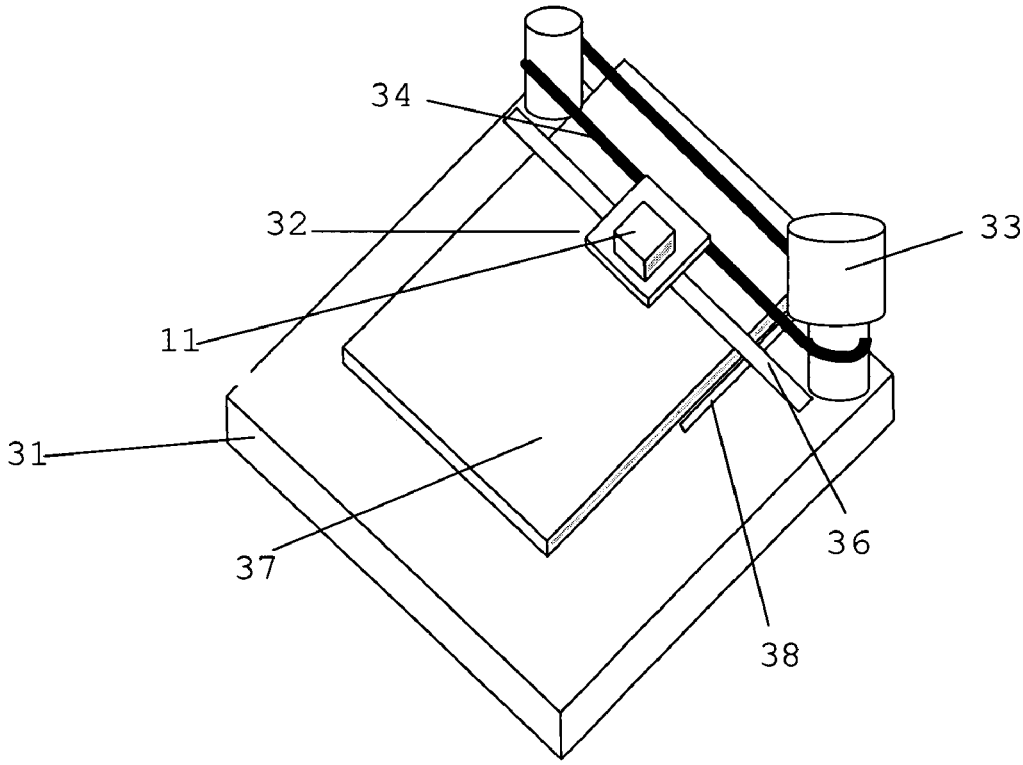
FIG. 22 is a highly schematic representation of an inkjet printer for use with the present invention.

In FIG. 22 a highly schematic general perspective view of an inkjet printer 30, which can be used with the present invention, is shown. The printer 30 includes a base 31, a carriage assembly 32, a step motor 33, a drive belt 34 driven by the step motor 33, and a guide rail assembly 36 for carrying the carriage assembly 32. Mounted on the carriage assembly 32 is a printhead 11 that has a plurality of nozzles 28.

The printhead 11 may also include one or more ink cartridges or any suitable ink supply system. A sheet of printing substrate such as paper 37 is fed in the slow scan direction over a support 38 by a feed mechanism (not shown). The carriage assembly 32 is moved along the guide rail assembly 36 by the action of the drive belt 34 driven by the step motor 33 in the fast scanning direction.

Figure 23:
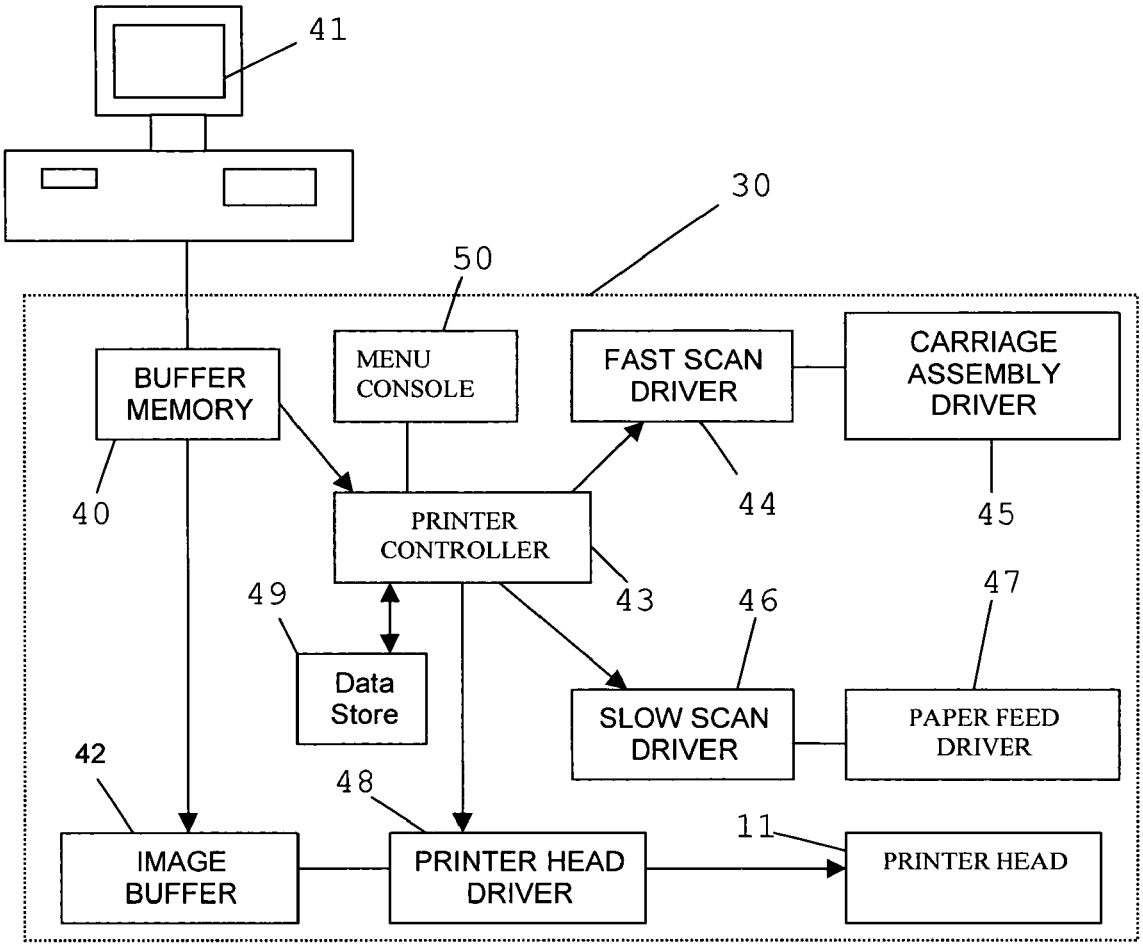
FIG. 23 is a schematic representation of a printer controller in accordance with an embodiment of the present invention.

FIG. 23 is a block diagram of the electronic control system of a printer 30, which is one example of a control system for use with a printhead 11 in accordance with the present invention. The printer 30 includes a buffer memory 40 for receiving a print file in the form of signals from a host computer 41, an image buffer 42 for storing printing data, and a printer controller 43 that controls the overall operation of the printer 30. Connected to the printer controller 43 are a fast scan driver 44 for a carriage assembly drive motor 45, a slow scan driver 46 for a paper feed drive motor 47, and a printhead driver 48 for the printhead 11.

Optionally, there is a data store 49 for storing parameters in accordance with the present invention. Host computer 41 may be any suitable programmable computing device such as personal computer with a Pentium IV microprocessor supplied by Intel Corp. USA, for instance, with memory and a graphical interface such as Windows 2000 as supplied by Microsoft Corp. USA. The printer controller 43 may include a computing device, e.g. microprocessor, for instance it may be a microcontroller. In particular, it may include a programmable printer controller, for instance a programmable digital logic element such as a Programmable Array Logic (PAL), a Programmable Logic Array, a Programmable Gate Array, especially a Field Programmable Gate Array (FPGA). The use of an FPGA allows subsequent programming of the printer device, e.g. by downloading the required settings of the FPGA.

The user of printer 30 can optionally set values into the data store 49 so as to modify the operation of the printhead 11. The user can for instance set values into the data store 49 by means of a menu console 50 on the printer 30. Alternatively, these parameters may be set into the data store 49 from host computer 41, e.g. by manual entry via a keyboard. For example, based on data specified and entered by the user, a printer driver (not shown) of the host computer 41 determines the various parameters that define the printing operations and transfers these to the printer controller 43 for writing into the data store 49.

The printer controller 43 may control the operation of printhead 11 in accordance with settable parameters stored in data store 49. Some commercially available drive circuitry for driving greyscale printheads can be delivered as part of the printhead assembly 11 and can be used to store waveform parameters on board. These parameters can for example be loaded from the printer controller 43 directly to printhead 11 itself. The printer controller 43 reads the required information contained in the printing data stored in the buffer memory 40 and sends control signals to the drivers 44, 46 and 48.

The present invention furthermore includes a computer program product that provides the functionality of any of the methods according to the present invention when executed on a computing device. Further, the present invention includes a data carrier such as a CD-ROM or a diskette which stores the computer product in a machine readable form and which executes at least one of the methods of the invention when executed on a computing device. Nowadays, such software is often offered on the Internet or a company Intranet for download, hence the present invention includes transmitting the printing computer product according to the present invention over a local or wide area network. The computing device may include one of a microprocessor and an FPGA.

The data store 49 may include any suitable device for storing digital data as known to the skilled person, e.g. a register or set of registers, a memory device such as RAM, EPROM or solid state memory.

Having described in detail preferred embodiments of the current invention, it will now be apparent to those skilled in the art that numerous modifications can be made therein without departing from the scope of the invention as defined in the appending claims. For example, with the method of the present invention, waveforms may be created for creating droplets with a high merging velocity and minimum voltage difference at different frequencies, for other types of printheads and other types of ink. Furthermore, instead of ink, any other material that can be printed onto a printing substrate may be used.

As to the printheads, the present invention has been described with regard to an inkjet printhead of the squeeze-tube geometry type, where the transducer moves radially under excitation. The planar piezoelectric drivers bend inward toward the ink. However, the present invention is not limited thereto, but can equally well be applied to other inkjet printheads, for example of the elongated piezoelectric slab type, which act like a push-rod, to inkjet printheads of the perpendicular oil can design, or to inkjet printheads of the fluid-sheet oil can design, all as illustrated in "Imaging and Information Storage Technology", Ed. Wolfgang Gerhartz, VCH, p. 39.

The invention claimed is:

1. A greyscale printhead comprising:

a nozzle plate, an ink chamber, and a source of ink;

means for generating ink drops to be ejected from the greyscale printhead;

drive circuitry for driving the means for generating ink drops by using different waveforms having a different number of pulses, the number of pulses being proportional to the volume of the ink drop;

wherein the drive circuitry, when operated, drives the different waveforms with a single voltage, and the printhead includes means for storing waveform parameters characterizing a width of each of the different number of pulses of the different waveforms and a time between two subsequent pulses of the different waveforms such that said ink drops of a different volume, ejected from said printhead, have a velocity substantially the same within a tolerance of 25%.

2. The greyscale printhead according to claim 1, wherein each pulse of the different number of pulses is characterised by a first opening pulse, creating outward bending of a channel wall of the ink chamber so as to open up an ink channel, and a closing pulse, leading to droplet generation and ejection, and wherein the drive circuitry is adapted for applying the first opening pulse, thereafter applying tube closing pulse located in a range of about one quarter to one-half of a resonance period of the ink chamber after the first opening pulse to thereby eject a first droplet, and thereafter applying a next opening pulse located at a position between one-half and three-quarters of the resonance period of the ink chamber after the first opening pulse.

3. A method greyscale printing onto a printing substrate using drops of ink ejected from a printhead by an application of pulses, the method comprising:

generating ink drops of different volumes by using different waveforms having a different numbers of pulses, the number of pulses being proportional to the volume of the ink drop;

applying the different waveforms with a single drive voltage, and adjusting a width of each of the different pulses of the waveform and a time between two subsequent pulses of the waveform such that said drops of different volumes, ejected from said printhead, have a velocity substantially the same within a tolerance of 25%.

4. The method according to claim 3, wherein each pulse of the different number of pulses is characterised by an opening pulse, creating outward bending of a channel wall of an ink chamber so as to open up an ink channel, and a closing pulse, leading to droplet generation and ejection, the method further comprising:

applying a first said opening pulse;

thereafter applying a first said closing pulse located in a range of about one-quarter to one-half of a resonance period of the ink chamber after the first opening pulse to thereby eject a first droplet, and;

thereafter applying a next opening pulse located at a position between one-half and three-quarters of the resonance period of the ink chamber after the first opening pulse.

* * * * *